US007389185B2

(12) United States Patent
Craig

(10) Patent No.: US 7,389,185 B2
(45) Date of Patent: Jun. 17, 2008

(54) METHODS AND SYSTEMS FOR DETERMINING RESERVOIR PROPERTIES OF SUBTERRANEAN FORMATIONS WITH PRE-EXISTING FRACTURES

(75) Inventor: David P. Craig, Thornton, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/245,839

(22) Filed: Oct. 7, 2005

(65) Prior Publication Data

US 2007/0083331 A1 Apr. 12, 2007

(51) Int. Cl.
*G01V 9/00* (2006.01)

(52) U.S. Cl. ..... 702/13

(58) Field of Classification Search ..... 702/6, 702/9, 12, 13, 14, 16
See application file for complete search history.

(56) References Cited

U.S. PATENT DOCUMENTS

| | | | | |
|---|---|---|---|---|
| 3,285,064 | A | 11/1966 | Greenkorn et al. | 73/155 |
| 4,797,821 | A | 1/1989 | Petak et al. | 364/422 |
| 2002/0096324 | A1 | 7/2002 | Poe | |
| 2005/0216198 | A1 | 9/2005 | Craig | 702/12 |
| 2005/0222852 | A1 | 10/2005 | Craig | |

FOREIGN PATENT DOCUMENTS

WO WO 03/014524 A1 2/2003

OTHER PUBLICATIONS

Esphahanian, C. and Storhaug, D.G.:"A Statistical Approach to Pay Identification in the Tight, Fractured, Heterogeneous Reservoirs of the Piceance Basin," paper SPE 38366 presented at the 1997 Rocky Mountain Regional Meeting, Casper, Wyoming, May 18-21, 1997.

Eberhard, M. and Mullen, M.:"The Effect of Completion Methodologies on Production in the Jonah Field," *SPE Production & Facilities* (Aug. 2003) 145.

Barree, R.D., et al.:"A Pratical Guide to Hydraulic Fracture Diagnostic Technologies," paper SPE 77442 presented at the 2002 SPE Annual Technical Conference and Exhibition, San Antonio, Texas, Sep. 29-Oct. 2, 2002.

(Continued)

*Primary Examiner*—Donald E McElheny, Jr.
(74) *Attorney, Agent, or Firm*—Craig W. Roddy; Baker Botts L.L.P.

(57) ABSTRACT

Methods and systems are provided for evaluating subsurface earth oil and gas formations. More particularly, methods and systems are provided for determining reservoir properties such as reservoir transmissibilities and average reservoir pressures of formation layer(s) using quantitative refracture-candidate diagnostic methods. The methods herein may use pressure falloff data from the introduction of an injection fluid at a pressure above the formation fracture pressure to analyze reservoir properties. The model recognizes that a new induced fracture creates additional storage volume in the formation and that a quantitative refracture-candidate diagnostic test in a layer may exhibit variable storage during the pressure falloff, and a change in storage may be observed at hydraulic fracture closure. From the estimated formation properties, the methods may be useful for, among other things, determining whether a pre-existing fracture is damaged and evaluating the effectiveness of a previous fracturing treatment to determine whether a formation requires restimulation.

21 Claims, 13 Drawing Sheets

OTHER PUBLICATIONS

Fisher, K., et al.:"A Comprehensive Study of the Analysis and Economic Benefit of Radioactve Tracer Engineered Stimulation Procedures," paper SPE 30794 presented at the 1995 SPE Annual Technical COnference and Exhibition, Dallas, Texas, Oct. 22-25, 1995.

Griffin, L.G., et al.:"Hydraulic Fracture Mapping of the High-Termpeature, High-Pressure Bossier Sands in East Texas," paper SPE 84489 presented at the 2003 SPE Annual Technical Conference and Exhibition, Denver, Colorado, Oct. 5-8, 2003.

Ehlig-Economides, C.A. and Joseph, J.:"A New Test for Determination of Individual Layer Properties in a Multilayered Reservoir," *SPE 14167 Formation Evaluation* (Sep. 1987) 261.

Jochen, J.E., et al.:"Quantifying Layered Reservoir Properties With a Novel Permeability Test," paper SPE 25864 presented at the 1993 SPE Rocky Mountain Regional/Low Permeability Symposium, Denver, Colorado, Apr. 12-14, 1993.

Hopkins, C.W., et al.:"The Use of Injection/Falloff Tests and Pressure Buildup Tests to Evaluate Fracture Geometry and Post-Stimulation Well Performance in the Devonian Shales," paper SPE 23433 presented at the 1991 SPE Eastern Regional Meeting, Lexington, Kentucky, Oct. 22-25, 1991.

Reeves, S.R.:"Natural Gas Production Enhancement via Restimulation," final report, Contract No. 5097-210-4090, Gas Research Institute, Chicago, Illinois (Jun. 2001).

Huang, H., et al.:"A Short Shut-In Time Testing Method for Determining Stimulation Effectiveness in Low Permeability Gas Reservoirs," *GASTips* (Fall 2000), 6, No. 4, 28.

Frantz, J.H., Jr., et al.:"Novel Well Testing Procedures Prove Successful in Dakota Formation Infill Program, San Juan Basin," paper SPE 71519 presented at the 2001 SPE Annual Technical Conference and Exhibition, New Orleans, Louisiana, Sep. 30, 2001-Oct. 3.

Craig, D.P., et al: "Permeability, Pore Pressure, and Leakoff-Type Distributions in Rocky Mountain Basins,"*SPE Production & Facilities* (Feb. 2005) 48.

Mayerhofer, M.J. and Economides, M.J.: "Permeability Estimation From Fracture Calibration Treatments," paper SPE 26039 presented at the 1993 Western Regional Meeting, Anchorage, Alaska, May 26-28, 1993.

Mayerhofer, M.J., Ehlig-Economides, C.A., and Economides, M.J.: "Pressure-Transient Analysis of Fracture-Calibration Tests," JPT (Mar. 1995) 229.

Gu, H., et al.: "Formation Permeability Determination Using Impulse-Fracture Injection," paper SPE 25425 presented at the 1993 SPE Production Operations Symposium, Oklahoma City, Oklahoma, Mar. 21-23, 1993.

Abousleiman, Y., Cheng, A. H-D., and Gu, H.: Formation Permeability Determination by Micro or Mini-Hydraulic Fracturing, *J. of Energy Resources Technology* (Jun. 1994) 116, No. 6, 104.

Larsen, L. and Bratvold, R.B.: "Effects of Propagating Fractures on Pressure-Transient Injection and Falloff Data," paper SPE 20580 presented at the 1990 SPE Annual Technical Conference and Exhibition, New Orleans, Louisiana, Sep. 23-26, 1990.

Peres, A.M.M., et al.: "A New General Pressure-Analysis Procedure for Slug Tests," *SPE 18801 Formation Evaluation* (Dec. 1993) 292.

Koning, E.J.L. and Niko, H.: "Fractured Water-Injection Wells: A Pressure Falloff Test for Determining Fracturing Dimensions," paper SPE 14458 presented at the 1985 Annual Technical Conference and Exhibition of the Society of Petroleum Engineers, Las Vegas, NV, Sep. 22-25, 1985.

Koning, E.J.L.: "Waterflooding Under Fracturing Conditions," PhD Thesis, Delft Technical University, 1988.

van den Hoek, P.J.: "Pressure Transient Ananlysis in Fractured Produced Water Injection Wells," paper SPE 77946 presented at the 2002 SPE Asia Pacific Oil & Gas Conference, Melbourne, Australia, Oct. 8-10, 2002.

van den Hoek, P.J.: "A Novel Methodology to Derive the Dimensions and Degree of Containment of Waterflood-Induced Fractures From Pressure Transient Analysis," paper SPE 84289 presented at the 2003 SPE Annual Technical Conference and Exhibition, Denver, Colorado, Oct. 5-8, 2003.

Spivey, J.P. and Lee, W.J.: "Variable Wellbore Storage Models for a Dual-Volume Wellbore," paper SPE 56615 presented at the 1999 SPE Annual Technical Conference and Exhibition, Houston, Texas, Oct. 3-6, 1999.

Cinco-Ley, H. and Samaniego-V., F.: "Transient Pressure Analysis: Finite Conductivity Fracture Case Versus Damage Fracture Case," paper SPE 10179 presented at the 1981 SPE Annual Technical Conference and Exhibition, San Antonio, Texas, Oct. 5-7, 1981.

Valkó, P.P. and Economides, M.J.: "Fluid-Leakoff Delineation in High Permeability Fracturing," *SPE Production & Facilities* (May 1999) 117.

Correa, A.C. and Ramey, H.J., Jr.: "Combined Effects of Shut-In and Production: Solution With a New Inner Boundary Condition," paper SPE 15579 presented at the 1986 SPE Annual Technical Conference and Exhibition, New Orleans, Louisiana, Oct. 5-8, 1986.

Correa, A.C. and Ramey, H.J., Jr.: "A Method for Pressure Buildup Analysis of Drillstem Tests," paper SPE 16802 presented at the 1987 SPE Annual Technical Conference and Exhibition, Dallas, Texas, Sep. 27-30, 1987.

Correa, A.C. and Ramey, H.J., Jr.: "Application of the Unit Step Function to Unusual Well Test Problems," paper SPE 18156 presented at the 1988 SPE Annual Technical Conference and Exhibition, Houston, Texas, Oct. 2-5, 1988.

Ozkan, E. and Raghavan, R.: "New Solutions for Well-Test-Analysis Problems: Part 1—Analytical Considerations," *SPEFE* 18615 (Sep. 1991), 359.

Ozkan, E. and Raghavan, R.: "New Solutions for Well-Test-Analysis Problems: Part 2—Computational Considerations and Applications," *SPEFE* 18616 (Sep. 1991), 369.

Nolte, K.G.: "Determination of Fracture Parameters From Fracturing Pressure Decline," paper SPE 8341 presented at the 1979 SPE Annual Technical Conference and Exhibition, Dallas, Texas, Sep. 23-25, 1979.

Ozkan, E., Yildiz, T., and Kuchuk, F.J.: "Transient Pressure Behavior of Duallateral Wells," SPE 38670 presented at the 1997 SPE Annual Technical Conference and Exhibition, San Antonio, Texas Oct. 5-8, 1997.

Raghavan, R., Chen, C-C, and Agarwal, B.: "An Analysis of Horizontal Wells Intercepted by Multiple Fractures," SPEJ 27652 (Sep. 1997) 235.

Kuchuk, F.J., et al.: "Pressure-Transient Behavior of Horizontal Wells With and Without Gas Cap or Aquifer," *SPE 17413 Formation Evaluation* (Mar. 1991) 86.

Wilkinson, D. and Hammond, P.S.:"A Perturbation Method for Mixed Boundary-Value Problems in Pressure Transient Testing," *Transport in Porous Media* (1990) 5, 609-636.

Stehfest, H.:"Numerical Inversion of Laplace Transforms," Communications of the ACM (Jan. 1970), 13, No. 1, 47-49.

Cinco-L., H., Samaniego-V, F., and Dominguez-A, F.: "Transient Pressure Behavior for a Well With a Finite-Conductivity Vertical Fracture," *SPEJ 6014* (Aug. 1978) 253.

Ayoub, J.A., et al.: "Impulse Testing," SPE Formation Evaluation (Sep. 1988) 534.

Ramey, H.J., Jr., Agarwal, R.G., and Martin, I.: "Analysis of 'Slug Test' or DST Flow Period Data," J. Cdn. Pet. Tech. (Jul.-Sep. 1975) 37.

Ramey, H.J., Jr. and Agarwal, R.G.: "Annulus Unloading Rates as Influenced by Wellbore Storage and Skin Effect," SPEJ 3538 (Oct. 1972) 453; Trans. AIME, 253.

Rushing, J.A., et al.: "Analysis of Slug Test Data From Hydraulically Fractured Coalbed Methan Wells," paper SPE 21492 presented at the 1991 SPE Gas Technology Symposium, Houston, Texas Jan. 23-25, 1991.

Ramey, H.J. Jr. and Gringarten, A.C.: "Effect of High Volume Vertical Fractures on Geothermal Steam Well Behavior," Proc., Second United Nations Symposium on the Use and Development of Geothermal Energy, San Francisco, California (May 20-29, 1975).

Xiao, J.J. and Reynolds, A.C.: "A Pseudopressure-Pseudotime Transformation for the Analysis of Gas Well Closed Chamber Tests," paper SPE 25879 presented at the 1993 SPE Rocky Mountain Regional/Low-Permeability Reservoirs Symposium, Denver, Colorado, Apr. 12-14, 1993.

Lee, W.J. and Holditch, S.A.: "Application of Pseudotime to Buildup Test Analysis of Low-Permeabilty Gas Wells With Long-Duration Wellbore Storage Distortion," JPT 9888 (Dec. 1982) 2877.
Meunier, D.F., et al.: "Gas Well Test Analysis; Use of Normalized Pseudovariables," SPEFE 13082 (Dec. 1987) 529.
Barree, R.D. and Mukherjee, H.: "Determination of Pressure Dependent Leakoff and its Effect on Fracture Geometry," paper SPE 36424 presented at the 1996 SPE Annual Technical Conference and Exhibition, Denver, Colorado, Oct. 6-9, 1996.
Howard, G.C. and Fast, C.R.: Optimum Fluid Characteristics for Fracture Extension, Drilling and Production Practices (1957), API, 261-270.
Valkó, P. and Economides, M.J.: "Material Balance," Hydraulic Fracture Mechanics, John Wiley & Sons, New York City (1997) Chap. 8, 165-188.
Valkó, P. and Economides, M.J.: "Fracture Height Containment With Continuum Damage Mechanics," paper SPE 26598 presented at the 1993 SPE Annual Technical Conference and Exhibition, Houston, Texas Oct. 3-6, 1993.
Oberhettinger, F.: "Hypergeometric Functions," Handbook of Mathematical Functions, Milton Abramowitz and Irene A. Stegun (eds.), Dover Publications, New York City (1965). Chap. 15, 555-566.
Nolte, K.G.: "A General Analysis of Fracturing Pressure Decline With Application to Three Models," SPEFE 12941 (Dec. 1986) 57.
Craig, D.P., Eberhard, M.J., and Barree, R.D.: "Adapting High Permeability Leakoff Analysis to Low Permeability Sands for Estimating Reservoir Engineering Parameters," paper SPE 60291 presented at the 2000 SPE Rocky Mountain Regional/Los Permeability Reservoirs Symposium, Denver, Colorado, Mar. 12-15, 2000.
Gringarten, A.C., Ramey, H.J., Jr., Raghavan, R.: "Unsteady-State Pressure Distributions Created by a Well With a Single Infinite-Conductivity Vertical Fracture," SPEJ 4051 (Aug. 1974) 347.
Ehlig-Economides, C.A., Fan, Y., and Economides, M.J.: "Interpretation Model for Fracture Calibration Tests in Naturally Fractured Reservoirs," paper SPE 28690 presented at the 1994 SPE International Petroleum Conference and Exhibition of Mexico, Veracruz, Mexico, Oct. 10-13, 1994.
Nolte, K.G.: "Background for After-Closure Analysis of Fracture Calibration Tests," unsolicited paper SPE 39407 available from SPE, Richardson, Texas (1997).
Bourdet, D.: "Special Tests,," *Well Test Analysis: The Use of Advanced Interpretation Models*, Elsevier, New York (2002), Chap. 9, 335.
Butler, J.J., Jr.: "The Performance of Slug Tests," *The Design, Performance, and Analysis of Slug Tests*, Lewis Publishers, Boca Raton (1997), 33.
Kuuskraa, V.A., et al.: "Economic and Technical Rationale for Remediating Inefficiently Producing Eastern Gas Shale and Coalbed Methane Wells," paper SPE 26894 presented at the 1993 SPE Eastern Regional Conference & Exhibition, Pittsburgh, Pennsylvania, Nov. 2-4, 1993.
Hower, T.L. and Decker, M.K.: "Identifying Recompletion Candidates in Stratified Gas Reservoirs," paper SPE 24307 presented at the 1992 SPE Mid-Continent Gas Symposium, Amarillo, Texas, Apr. 13-14, 1992.
Fetkovich, M.J., et al.: "Depletion Performance of Layered Reservoirs Without Crossflow," *SPE 18266 Formation Evaluation* (Sep. 1990) 310.
Fetkovich, M.J.: "Advanced Decline Curve Analysis Identifies Fracture Stimulation Potential," paper SPE 38903 presented at the 1997 SPE Annual Technical Conference and Exhibition, San Antonio, Texas, Oct. 5-8, 2997.
McCoy, T.F., et al.: "Depletion Performance of Poorly Stimulated Layered Reservoirs Without Crossflow," paper SPE 59757 presented at the 2000 SPE/CERI Gas Technology Symposium, Calgary, Alberta, Canada, Apr. 3-5, 2000.
McCain, W.D., et al.: "A Tight Gas Field Study: Carthage (Cotton Valley) Field," paper SPE 26141 presented at the 1993 SPE Gas Technology Symposium, Calgary, Alberta, Canada, Jun. 28-30, 1993.
Voneiff, G.W. and Cipolla, C.: "A New Approach to Large-Scale Infill Evaluations Applied to the OZONA (Canyon) Gas Sands," paper SPE 35203 presented at the 1996 SPE Permian Basin Oil & Gas Recovery Conference, Midland, Texas, Mar. 27-29, 1996.
Mohaghegh, S.: "Performance Drivers in Restimulation of Gas-Storage Wells," *SPE Reservoir Evaluation & Engineering* (Dec. 2001) 536.
Shelley, F.R.: "Artificial Neural Networks Identify Restimulation Candidates in the Red Oak Field," paper SPE 52190 presented at the 1999 SPE Mid-Continent Operations Symposium, Oklahoma City, Oklahoma, Mar. 28-31, 1999.
Oberwinkler, C. and Economides, M.J.: "The Definitive Identification of Candidate Wells for Refracturing," paper SPE 84211 presented at the 2003 SPE Annual Technical Conference and Exhibition, Denver, Colorado, Oct. 5-8, 2003.
Conway, M.W., et al.: "Expanding Recoverable Reserves Through Refracturing," paper SPE 14376 presented at the 1985 SPE Annual Technical Conference and Exhibition of the Society of Petroleum Engineers, Las Vegas, Nevada, Sep. 22-25, 1985.
Voneiff, G.W., et al.: "The Effects of Unbroken Fracture Fluid on Gas Well Performance," SPE 26664 available from SPE, Richardson, Texas (1994).
Williams, P.: "Value in the Vicksburg," *Oil & Gas Investori* (Aug. 2004) 24, No. 8, 49.
Williams, P.: "The Barnett Shale," *Oil & Gas Investor* (Mar. 2002) 22, No. 3, 34.
Williams, P.: "Wattenberg Revival," *Oil & Gas Investor* (Mar. 1999) 19, No. 3, 22.
Moritis, G.: "Diagnosing Underperforming Wells," *Oil & Gas Journal* (Dec. 4, 2000) 98, No. 49, 23.
Elbel, J.L. and Mack, M.G.: "Refracturing: Observations and Theories," paper SPE 25464 presented at the 1993 SPE Production Operations Symposium, Oklahoma City, Oklahoma, Mar. 21-23, 1993.
Wright, C.A., et al.: "Reorientation of Proposed Refracture Treatments in the Lost Hills Field," paper SPE 27896 presented at the 1994 SPE Western Regional Meeting, Long Beach, California, Mar. 23-25, 1994.
Wright, C.A. and Conant, R.A.: "Hydraulic Fracture Reorientation in Primary and Secondary Recovery from Low-Permeability Reservoirs," paper SPE 30484 presented at the 1995 SPE Annual Technical Conference and Exhibition, Dallas, Texas, Oct. 22-25, 1995.
Siebrits, E., et al.: "Refracture Reorientation Enhances Gas Production in Barnett Shale Tight Gas Wells," SPE 63030 presented at the 2000 SPE Annual Technical Conference and Exhibition, Dallas, Texas, Oct. 1-4, 2000.
Howard, G.C. and Fast, C.R.: "Results of Hydraulic Fracturing," *Hydraulic Fracturing*, Monograph Series, SPE, Richardson, Texas (1970) 2, 172-176.
Reese, J.L., et al.: "Selecting Economic Refracturing Candidates," paper SPE 28490 presented at the 1994 SPE Annual Technical Conference and Exhibition, New Orleans, Louisiana, Sep. 25-28, 1994.
Crowell, R.F. and Jennings, A.R.: "A Diagnostic Technique for Restimulation Candidate Selection," paper SPE 7556 presented at the 1978 SPE Annual Fall Technical Conference and Exhibition, Houston, Texas, Oct. 1-3, 1978.
Reeves, S.R., et al.: "Restimulation of Tight Gas Sand Wells in the Rocky Mountain Region," paper SPE 55627 presented at the 1999 SPE Rocky Mountain Regional Meeting, Gillette, Wyoming, May 15-18, 1999.
Reeves, S.R., et al.: "Restimulation Technology for Tight Gas Sand Wells," paper SPE 56482 presented at the 1999 SPE Annual Technical Conference and Exhibition, Houston, Texas, Oct. 3-6, 1999.
Reeves, S. and Wolhart, S.: "Study Looks at Tight-Gas Restimulation Candidate Wells," *Oil & Gas Journal* (Oct. 8, 2001) 99, No. 41, 37.
Cox, D.O., et al.: "Advanced Type Curve Analysis for Low Permeabilty Gas Reservoirs," paper SPE 35595 presented at the 1996 SPE Gas Technology Conference, Calgary, Alberta, Canada, Apr. 28-May 1, 1996.
Reeves, S. and Wolhart, S.: "Insights Into Restimulation Candidate Selection," *GasTIPS* (Fall 2001) 7, No. 4, 15.

Ely, J.W., et al.: "Restimulation Program Finds Success in Enhancing Recoverable Reserves," paper SPE 63241 presented at the 2000 SPE Annual Technical Conference and Exhibition, Dallas, Texas, Oct. 1-4, 2000.

Hopkins, C.W., et al.: "Screening Restimulation Candidates in the Antrim Shale," paper SPE 29172 presented at the 1994 SPE Eastern Regional Conference & Exhibition, Charleston, West Virginia, Nov. 8-10, 1994.

International Search Report and Written Opinion for Application No. PCT/GB2006/003656, Feb. 10, 2006.

International Search Report and Written Opinion for Application No. PCT/GB2006/003658, Feb. 10, 2006.

Waterflood-Induced Hydraulic Fracturing, Jun. 11, 2004.

METHODS AND SYSTEMS FOR DETERMINING RESERVOIR PROPERTIES OF SUBTERRANEAN FORMATIONS WITH PRE-EXISTING FRACTURES

CROSS-REFERENCE TO RELATED APPLICATION

The present invention is related to U.S. Pat. No. 7,272,973 entitled "Methods and Apparatus for Determining Reservoir Properties of Subterranean Formations," filed concurrently herewith, the entire disclosure of which is incorporated herein by reference.

BACKGROUND

The present invention relates to the field of oil and gas subsurface earth formation evaluation techniques and more particularly, to methods and an apparatus for determining reservoir properties of subterranean formations using quantitative refracture-candidate diagnostic test methods.

Oil and gas hydrocarbons may occupy pore spaces in subterranean formations such as, for example, in sandstone earth formations. The pore spaces are often interconnected and have a certain permeability, which is a measure of the ability of the rock to transmit fluid flow. Hydraulic fracturing operations can be performed to increase the production from a well bore if the near-wellbore permeability is low or when damage has occurred to the near-well bore area.

Hydraulic fracturing is a process by which a fluid under high pressure is injected into the formation to create and/or extend fractures that penetrate into the formation. These fractures can create flow channels to improve the near term productivity of the well. Propping agents of various kinds, chemical or physical, are often used to hold the fractures open and to prevent the healing of the fractures after the fracturing pressure is released.

Fracturing treatments may encounter a variety of problems during fracturing operations resulting in a less than optimal fracturing treatment. Accordingly, after a fracturing treatment, it may be desirable to evaluate the effectiveness of the fracturing treatment just performed or to provide a baseline of reservoir properties for later comparison and evaluation. One example of a problem occasionally encountered in fracturing treatments is bypassed layers. That is, during an original completion, oil or gas wells may contain layers bypassed either intentionally or inadvertently.

The success of a hydraulic fracture treatment often depends on the quality of the candidate well selected for the treatment. Choosing a good candidate for stimulation may result in success, while choosing a poor candidate may result in economic failure. To select the best candidate for stimulation or restimulation, there are many parameters to be considered. Some important parameters for hydraulic fracturing include formation permeability, in-situ stress distribution, reservoir fluid viscosity, skin factor, and reservoir pressure. Various methods have been developed to determine formation properties and thereby evaluate the effectiveness of a previous stimulation treatment or treatments.

Conventional methods designed to identify underperforming wells and to recomplete bypassed layers have been largely unsuccessful in part because the methods tend to oversimplify a complex multilayer problem and because they focus on commingled well performance and well restimulation potential without thoroughly investigating layer properties and layer recompletion potential. The complexity of a multilayer environment increases as the number of layers with different properties increases. Layers with different pore pressures, fracture pressures, and permeability can coexist in the same group of layers. A significant detriment to investigating layer properties is a lack of cost-effective diagnostics for determining layer permeability, pressure, and quantifying the effectiveness of a previous stimulation treatment or treatments.

These conventional methods often suffer from a variety of drawbacks including a lack of desired accuracy and/or an inefficiency of the computational method resulting in methods that are too time consuming. Furthermore, conventional methods often lack accurate means for quantitatively determining the transmissibility of a formation.

Post-frac production logs, near-wellbore hydraulic fracture imaging with radioactive tracers, and far-field microseismic fracture imaging all suggest that about 10% to about 40% of the layers targeted for completion during primary fracturing operations using limited-entry fracture treatment designs may be bypassed or ineffectively stimulated.

Quantifying bypassed layers has traditionally proved difficult because, in part, so few completed wells are imaged. Consequently, bypassed or ineffectively stimulated layers may not be easily identified, and must be inferred from analysis of a commingled well stream, production logs, or conventional pressure-transient tests of individual layers.

One example of a conventional method is described in U.S. Patent Publication 2002/0096324 issued to Poe, which describes methods for identifying underperforming or poorly performing producing layers for remediation or restimulation. This method, however, uses production data analysis of the produced well stream to infer layer properties rather than using a direct measurement technique. This limitation can result in poor accuracy and further, requires allocating the total well production to each layer based on production logs measured throughout the producing life of the well, which may or may not be available.

Other methods of evaluating effectiveness of prior fracturing treatments include conventional pressure-transient testing, which includes drawdown, buildup, injection/falloff testing. These methods may be used to identify an existing fracture retaining residual width from a previous fracture treatment or treatments, but conventional methods may require days of production and pressure monitoring for each single layer. Consequently, in a wellbore containing multiple productive layers, weeks to months of isolated-layer testing can be required to evaluate all layers. For many wells, the potential return does not justify this type of investment.

Diagnostic testing in low permeability multilayer wells has been attempted. One example of such a method is disclosed in Hopkins,. C. W., et al., *The Use of Injection/Falloff Tests and Pressure Buildup Tests to Evaluate Fracture Geometry and Post-Stimulation Well Performance in the Devonian Shales*, paper SPE 23433, 22-25 (1991). This method describes several diagnostic techniques used in a Devonian shale well to diagnose the existence of a pre-existing fracture(s) in multiple targeted layers over a 727 fit interval. The diagnostic tests include isolation flow tests, wellbore communication tests, nitrogen injection/falloff tests, and conventional drawdown/buildup tests.

While this diagnostic method does allow evaluation of certain reservoir properties, it is, however, expensive and time consuming—even for a relatively simple case having only four layers. Many refracture candidates in low permeability gas wells contain stacked lenticular sands with between 20 to 40 layers, which need to be evaluated in a timely and cost effective manner.

Another method uses a quasi-quantitative pressure transient test interpretation method as disclosed by Huang, H., et al., *A Short Shut-In Time Testing Methodfor Determining Stimulation Effectiveness in Low Permeability Gas Reservoirs*, GASTIPS, 6 No. 4, 28 (Fall 2000). This "short shut-in test interpretation method" is designed to provide only an indication of pre-existing fracture effectiveness. The method uses log-log type curve reference points—the end of wellbore storage, the beginning of pseudolinear flow, the end of pseudolinear flow, and the beginning of pseudoradial flow—and the known relationships between pressure and system properties at those points to provide upper and lower limits of permeability and effective fracture half length.

Another method uses nitrogen slug tests as a prefracture diagnostic test in low permeability reservoirs as disclosed by Jochen, J. E., et al., *Quantifying Layered Reservoir Properties With a Novel Permeability Test*, SPE 25864,12-14 (1993). This method describes a nitrogen injection test as a short small volume injection of nitrogen at a pressure less than the fracture initiation and propagation pressure followed by an extended pressure falloff period. Unlike the nitrogen injection/falloff test used by Hopkins et al., the nitrogen slug test is analyzed using slug-test type curves and by history matching the injection and falloff pressure with a finite-difference reservoir simulator.

Similarly, as disclosed in Craig, D. P., et al., *Permeability, Pore Pressure, and Leakoff-Type Distributions in Rocky Mountain Basins*, SPE PRODUCTION & FACILITIES, 48 (February, 2005), certain types of fracture-injection/falloff tests have been routinely implemented since 1998 as a prefracture diagnostic method to estimate formation permeability and average reservoir pressure. These fracture-injection/falloff tests, which are essentially a minifrac with reservoir properties interpreted from the pressure falloff, differ from nitrogen slug tests in that the pressure during the injection is greater than the fracture initiation and propagation pressure. A fracture-injection/falloff test typically requires a low rate and small volume injection of treated water followed by an extended shut-in period. The permeability to the mobile reservoir fluid and the average reservoir pressure may be interpreted from the pressure decline. A fracture-injection/falloff test, however, may fail to adequately evaluate refracture candidates, because this conventional theory does not account for pre-existing fractures.

Thus, conventional methods to evaluate formation properties suffer from a variety of disadvantages including a lack of the ability to quantitatively determine the reservoir transmissibility, a lack of cost-effectiveness, computational inefficiency, and/or a lack of accuracy. Even among methods developed to quantitatively determine a reservoir transmissibility, such methods may be impractical for evaluating formations having multiple layers such as, for example, low permeability stacked, lenticular reservoirs.

SUMMARY

The present invention relates to the field of oil and gas subsurface earth formation evaluation techniques and more particularly, to methods and an apparatus for determining reservoir properties of subterranean formations using quantitative refracture-candidate diagnostic test methods.

In certain embodiments, a method for determining a reservoir transmissibility of at least one layer of a subterranean formation having preexisting fractures having a reservoir fluid comprises the steps of: (a) isolating the at least one layer of the subterranean formation to be tested; (b) introducing an injection fluid into the at least one layer of the subterranean formation at an injection pressure exceeding the subterranean formation fracture pressure for an injection period; (c) shutting in the wellbore for a shut-in period; (d) measuring pressure falloff data from the subterranean formation during the injection period and during a subsequent shut-in period; and (e) determining quantitatively a reservoir transmissibility of the at least one layer of the subterranean formation by analyzing the pressure falloff data with a quantitative refracture-candidate diagnostic model.

In certain embodiments, a system for determining a reservoir transmissibility of at least one layer of a subterranean formation by using variable-rate pressure falloff data from the at least one layer of the subterranean formation measured during an injection period and during a subsequent shut-in period comprises: a plurality of pressure sensors for measuring pressure falloff data; and a processor operable to transform the pressure falloff data to obtain equivalent constant-rate pressures and to determine quantitatively a reservoir transmissibility of the at least one layer of the subterranean formation by analyzing the variable-rate pressure falloff data using type-curve analysis according to a quantitative refracture-candidate diagnostic model.

In certain embodiments, a computer program, stored on a tangible storage medium, for analyzing at least one downhole property comprises executable instructions that cause a computer to: determine quantitatively a reservoir transmissibility of the at least one layer of the subterranean formation by analyzing the variable-rate pressure falloff data with a quantitative refracture-candidate diagnostic model.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention and should not be used to limit or define the invention.

DESCRIPTION OF PREFERRED EMBODIMENTS

Figure 1:
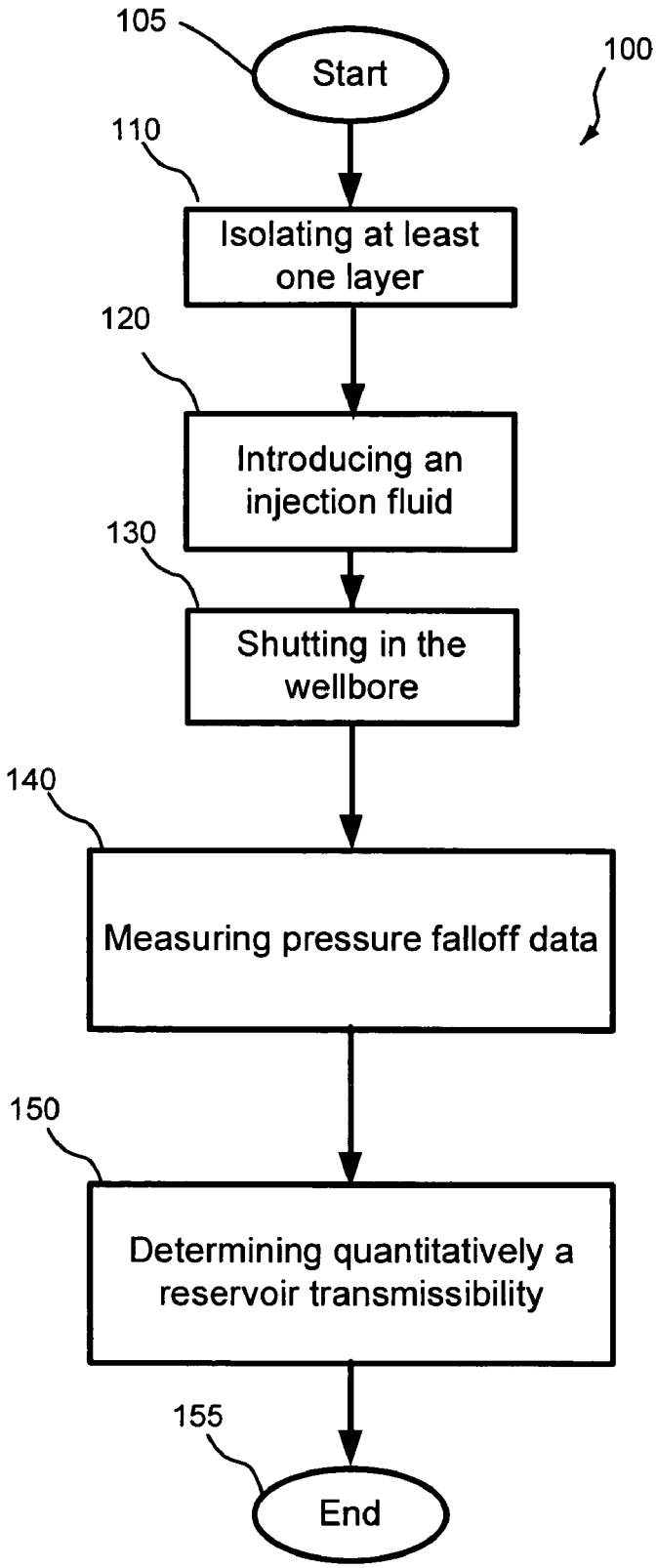
FIG. 1 is a flow chart illustrating one embodiment of a method for quantitatively determining a reservoir transmissibility.

The present invention relates to the field of oil and gas subsurface earth formation evaluation techniques and more particularly, to methods and an apparatus for determining reservoir properties of subterranean formations using quantitative refracture-candidate diagnostic test methods.

Methods of the present invention may be useful for estimating formation properties through the use of quantitative refracture-candidate diagnostic test methods, which may use injection fluids at pressures exceeding the formation fracture initiation and propagation pressure. In particular, the methods herein may be used to estimate formation properties such as, for example, the effective fracture half-length of a pre-existing fracture, the fracture conductivity of a pre-existing fracture, the reservoir transmissibility, and an average reservoir pressure. Additionally, the methods herein may be used to determine whether a pre-existing fracture is damaged. From the estimated formation properties, the present invention may be useful for, among other things, evaluating the effectiveness of a previous fracturing treatment to determine whether a formation requires restimulation due to a less than optimal fracturing treatment result. Accordingly, the methods of the present invention may be used to provide a technique to determine if and when restimulation is desirable by quantitative application of a refracture-candidate diagnostic fracture-injection falloff test method.

Generally, the methods herein allow a relatively rapid determination of the effectiveness of a previous stimulation treatment or treatments or treatments by injecting a fluid into the formation at an injection pressure exceeding the formation fracture pressure and recording the pressure falloff data. The pressure falloff data may be analyzed to determine certain formation properties, including if desired, the transmissibility of the formation.

In certain embodiments, a method of determining a reservoir transmissibility of at least one layer of a subterranean formation formation having preexisting fractures having a reservoir fluid compres the steps of: (a) isolating the at least one layer of the subterranean formation to be tested; (b) introducing an injection fluid into the at least one layer of the subterranean formation at an injection pressure exceeding the subterranean formation fracture pressure for an injection period; (c) shutting in the wellbore for a shut-in period; (d) measuring pressure falloff data from the subterranean formation during the injection period and during a subsequent shut-in period; and (e) determining quantitatively a reservoir transmissibility of the at least one layer of the subterranean formation by analyzing the pressure falloff data with a quantitative refracture-candidate diagnostic model.

The term, "refracture-candidate diagnostic test," as used herein refers to the computational estimates shown below in Sections I and II used to estimate certain reservoir properties, including the transmissibility of a formation layer or multiple layers. The test recognizes that an existing fracture retaining residual width has associated storage, and a new induced fracture creates additional storage. Consequently, a fracture-injection/falloff test in a layer with a pre-existing fracture will exhibit characteristic variable storage during the pressure falloff period, and the change in storage is observed at hydraulic fracture closure. In essence, the test induces a fracture to rapidly identify a pre-existing fracture retaining residual width.

The methods and models herein are extensions of and based, in part, on the teachings of Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005), which is incorporated by reference herein in full and U.S. patent application Ser. No. 10/813,698, filed Mar. 3, 2004, entitled "Methods and Apparatus for Detecting Fracture with Significant Residual Width from Previous Treatments, which is incorporated by reference herein in full.

FIG. 1 shows an example of an implementation of the quantitative refracture-candidate diagnostic test method implementing certain aspects of the quantitative refracture-candidate diagnostic model. Method 100 generally begins at step 105 for determining a reservoir transmissibility of at least one layer of a subterranean formation. At least one layer of the subterranean formation is isolated in step 110. During the layer isolation step, each subterranean layer is preferably individually isolated one at a time for testing by the methods of the present invention. Multiple layers may be tested at the same time, but this grouping of layers may introduce additional computational uncertainty into the transmissibility estimates.

An injection fluid is introduced into the at least one layer of the subterranean formation at an injection pressure exceeding the formation fracture pressure for an injection period (step 120). The injection fluid may be a liquid, a gas, or a mixture thereof. In certain exemplary embodiments, the volume of the injection fluid introduced into a subterranean layer may be roughly equivalent to the proppant-pack pore volume of an existing fracture if known or suspected to exist. Preferably, the introduction of the injection fluid is limited to a relatively short period of time as compared to the reservoir response time which for particular formations may range from a few seconds to minutes. In more preferred embodiments in typical applications, the introduction of the injection fluid may be limited to less than about 5 minutes. For formations having pre-existing fractures, the injection fluid is preferably introduced in such a way so as to produce a change in the existing and created fracture volume that is at least about twice the estimated proppant-pack pore volume. After introduction of the injection fluid, the wellbore may be shut-in for a period of time from a few minutes to a few days depending on the length of time for the pressure falloff data to show a pressure falloff approaching the reservoir pressure.

Pressure falloff data is measured from the subterranean formation during the injection period and during a subsequent shut-in period (step 140). The pressure falloff data may be measured by a pressure sensor or a plurality of pressure sensors. After introduction of the injection fluid, the wellbore may be shut-in for a period of time from about a few hours to a few days depending on the length of time for the pressure measurement data to show a pressure falloff approaching the reservoir pressure. The pressure falloff data may then be analyzed according to step 150 to determine a reservoir transmissibility of the subterranean formation according to the quantitative refracture-candidate diagnostic model shown below in more detail in Sections I and II. Method 100 ends at step 225.

Figure 2:
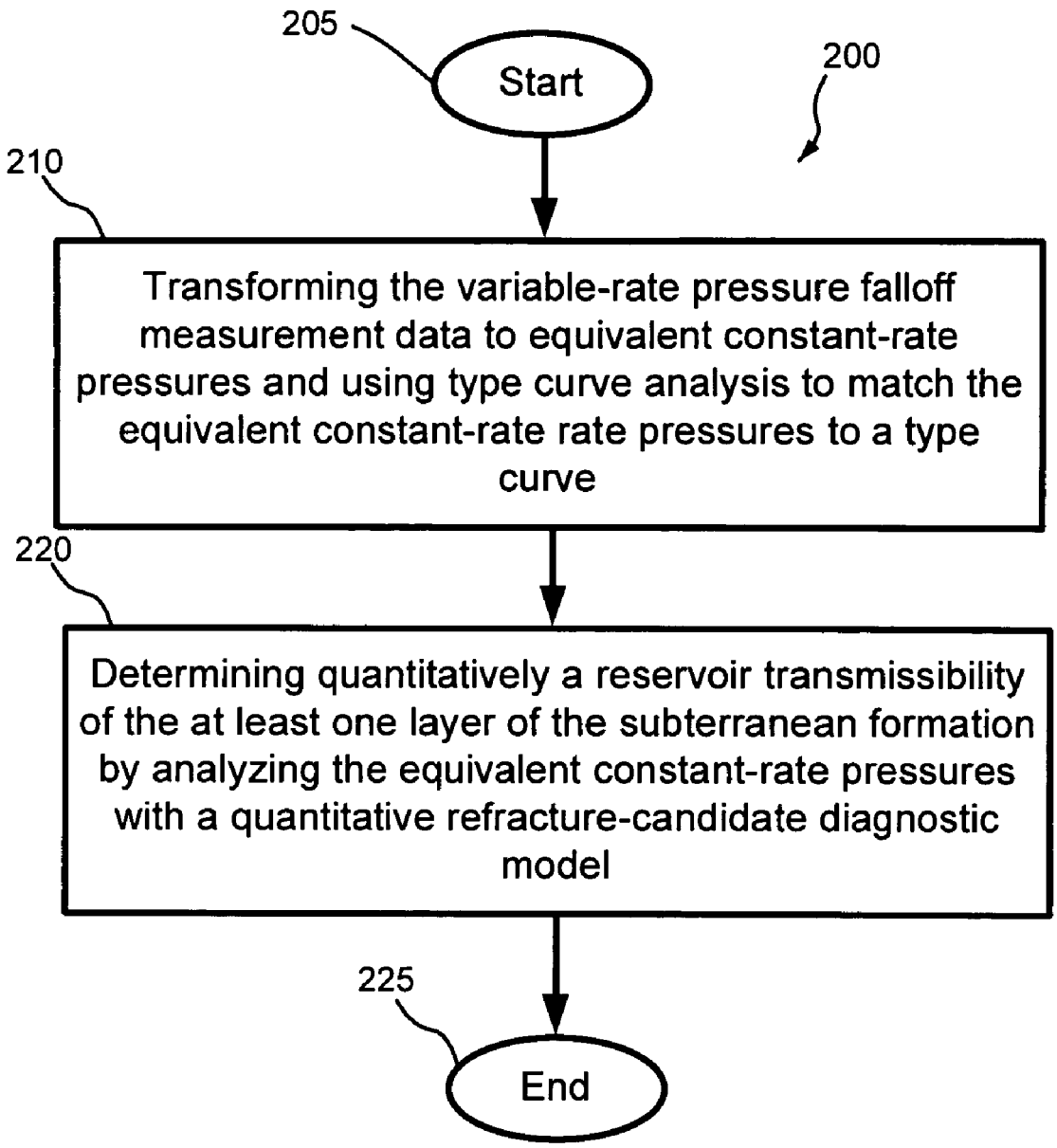
FIG. 2 is a flow chart illustrating one embodiment of a method for quantitatively determining a reservoir transmissibility.
Figure 3:
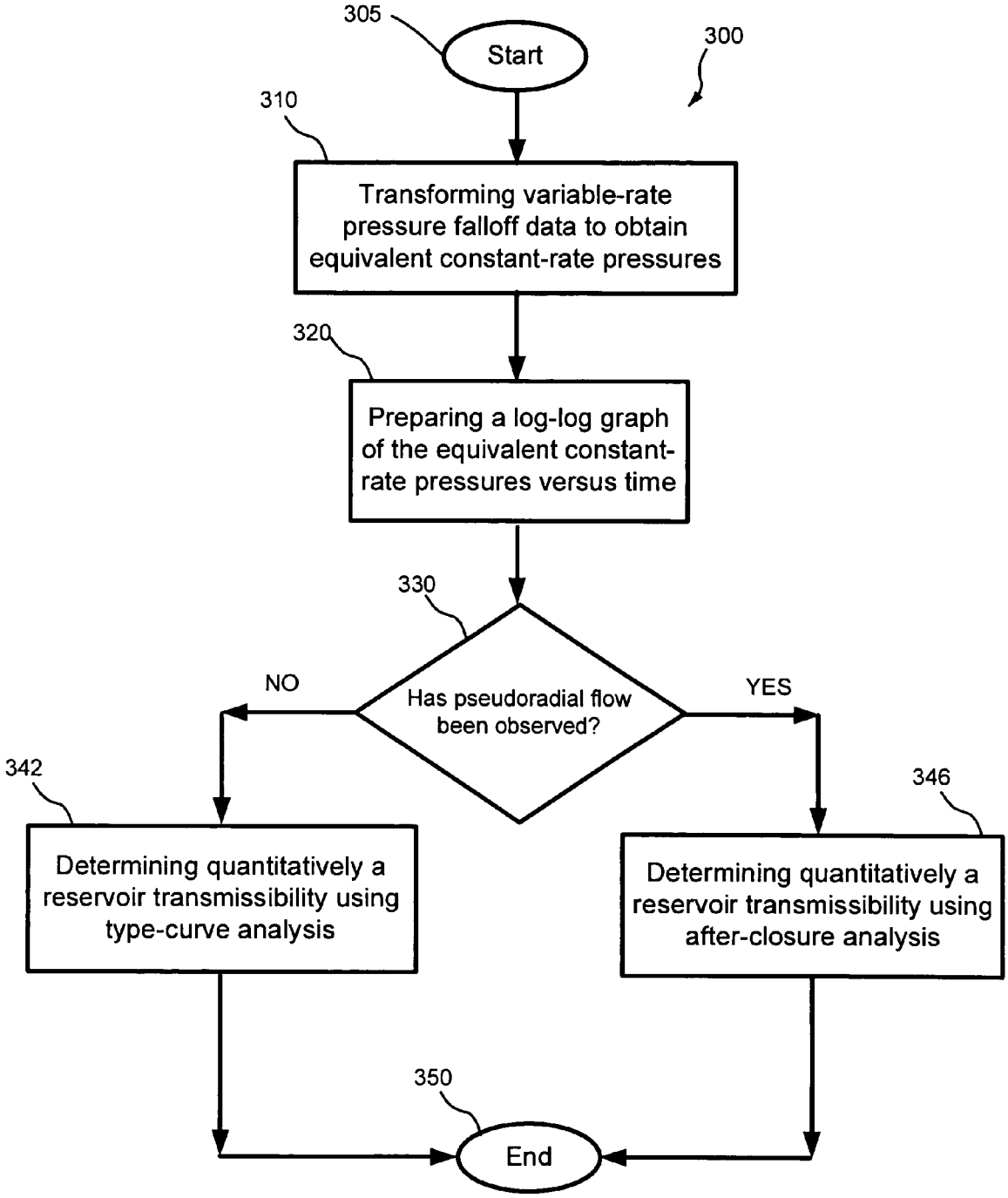
FIG. 3 is a flow chart illustrating one embodiment of a method for quantitatively determining a reservoir transmissibility.

FIG. 2 shows an example implementation of determining quantitatively a reservoir transmissibility (depicted in step 150 of Method 100). In particular, method 200 begins at step 205. Step 210 includes the step of transforming the variable-rate pressure falloff data to equivalent constant-rate pressures and using type curve analysis to match the equivalent constant-rate rate pressures to a type curve. Step 220 includes the step of determining quantitatively a reservoir transmissibility of the at least one layer of the subterranean formation by analyzing the equivalent constant-rate pressures with a quantitative refracture-candidate diagnostic model. Method 200 ends at step 225.

One or more methods of the present invention may be implemented via an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU or processor) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

I. Quantitative Refracture-Candidate Diagnostic Test Model

A refracture-candidate diagnostic test is an extension of the fracture-injection/falloff theoretical model with multiple arbitrarily-oriented infinite-or finite-conductivity fracture pressure-transient solutions used to adapt the model. The fracture-injection/falloff theoretical model is presented in U.S. Pat. No. 7,272,973 entitled "Methods and Apparatus for Determining Reservoir Properties of Subterranean Formations," filed concurrently herewith, the entire disclosure of which is incorporated by reference herein in full.

The test recognizes that an existing fracture retaining residual width has associated storage, and a new induced fracture creates additional storage. Consequently, a fracture-injection/falloff test in a layer with a pre-existing fracture will exhibit variable storage during the pressure falloff, and the change in storage is observed at hydraulic fracture closure. In essence the test induces a fracture to rapidly identify a pre-existing fracture retaining residual width.

Consider a pre-existing fracture that dilates during a fracture-injection/falloff sequence, but the fracture half length remains constant. With constant fracture half length during the injection and before-closure falloff, fracture volume changes are a function of fracture width, and the before-closure storage coefficient is equivalent to the dilating-fracture storage coefficient and written as $$C_{bc} = c_{wb}V_{wb} + 2c_f V_f + 2\frac{dV_f}{dp_w}. \quad (1)$$
$$= c_{wb}V_{wb} + 2\frac{A_f}{S_f}$$
$$= C_{fd}$$

(The nomenclature used throughout this specification is defined below in Section VI)

where $S_f$ is the fracture stiffness as presented by Craig, D. P., *Analytical Modeling of a Fracture-Injection/Falloff Sequence and the Development of a Refracture-Candidate Diagnostic Test*, PhD dissertation, Tex. A&M Univ., College Station, Texas (2005). With equivalent before-closure and dilated-fracture storage, a derivation similar to that shown below in Section III results in the dimensionless pressure solution written as $$p_{wsD}(t_{LfD}) = q_{wsD}[p_{acD}(t_{LfD}) - p_{acD}(t_{LfD} - (t_e)_{LfD})] + p_{wsD}(0)C_{acD}p'_{acD}(t_{LfD}) - (C_{bcD} - C_{acD})\int_0^{(t_c)_{LfD}} p'_{acD}(t_{LfD} - \tau_D)p'_{wsD}(\tau_D)d\tau_D. \quad (2)$$

Alternatively, a secondary fracture can be initiated in a plane different from the primary fracture during the injection. With secondary fracture creation, and assuming the volume of the primary fracture remains constant, the propagating-fracture storage coefficient is written as $$C_{Lf}(t_{LfD}) = c_{wb}V_{wb} + c_f V_{f1} + 2\frac{A_{f2}}{S_{f2}}\left(\frac{t_{LfD}}{(t_e)_{LfD}}\right)^{\alpha}. \quad (3)$$

The before-closure storage coefficient may be defined as $$C_{Lfbc} = c_{wb}V_{wb} + 2c_f V_{f1} + 2\frac{A_{f2}}{S_{f2}}, \quad (4)$$

and the after-closure storage coefficient may be written as $$C_{Lfac} = c_{wb}V_{wb} + 2c_f(V_{f1} + V_{f2}) \quad (5)$$

With the new storage-coefficient definitions, the fracture-injection/falloff sequence solution with a pre-existing fracture and propagating secondary fracture is written as $$p_{wsD}(t_{LfD}) = q_{wsD}[p_{pLfD}(t_{LfD}) - p_{pLfD}(t_{LfD} - (t_e)_{LfD})] - C_{LfacD}\int_0^{t_{LfD}} p'_{LfD}(t_{LfD} - \tau_D)p'_{wsD}(\tau_D)d\tau_D - \int_0^{(t_e)_{LfD}} p'_{pLfD}(t_{LfD} - \tau_D)C_{pLfD}(\tau_D)p'_{wsD}(\tau_D)d\tau_D + C_{LfbcD}\int_0^{(t_e)_{LfD}} p'_{LfD}(t_{LfD} - \tau_D)p'_{wsD}(\tau_D)d\tau_D - (C_{LfbcD} - C_{LfacD})\int_0^{(t_c)_{LfD}} p'_{LfD}(t_{LfD} - \tau_D)p'_{wsD}(\tau_D)d\tau_D \quad (6)$$

The limiting-case solutions for a single dilated fracture are identical to the fracture-injection/falloff limiting-case solutions—(Eqs. 19 and 20 of U.S. Patent No. 7,272,973)—when $(t_e)_{LfD} \square t_{LfD}$. With secondary fracture propagation, the before-closure limiting-case solution for $(t_e)_{LfD} \square t_{LfD} < (t_c)_{LfD}$ may be written as $$p_{wsD}(t_{LfD}) = p_{wsD}(0)C_{LfbcD}p'_{LfbcD}(t_{LfD}), \quad (7)$$

where $p_{LfbcD}$ is the dimensionless pressure solution for a constant-rate drawdown in a well producing from multiple fractures with constant before-closure storage, which may be written in the Laplace domain as $$\overline{p}_{LfbcD} = \frac{\overline{p}_{LfD}}{1 + s^2 C_{LfbcD}\overline{p}_{LfD}}, \tag{8}$$

and $\overline{p}_{LfD}$ is the Laplace domain reservoir solution for production from multiple arbitrarily-oriented finite-or infinite-conductivity fractures. New multiple fracture solutions are provided in below in Section IV for arbitrarily-oriented infinite-conductivity fractures and in Section V for arbitrarily-oriented finite-conductivity fractures. The new multiple fracture solutions allow for variable fracture half length, variable conductivity, and variable angle of separation between fractures.

The after-closure limiting-case solution with secondary fracture propagation when $t_{LfD}$□$(t_c)_{LfD}$□$(t_e)_{LfD}$ is written as $$p_{wsD}(t_{LfD}) = \begin{bmatrix} p_{wsD}(0)C_{LfbcD} - \\ p_{wsD}((t_c)_{LfD})(C_{LfbcD} - C_{LfacD}) \end{bmatrix} p'_{LfacD}(t_{LfD}) \tag{9}$$

where $p_{LfacD}$ is the dimensionless pressure solution for a constant-rate drawdown in a well producing from multiple fractures with constant after-closure storage, which may be written in the Laplace domain as $$\overline{p}_{LfbcD} = \frac{\overline{p}_{LfD}}{1 + s^2 C_{LfacD}\overline{p}_{LfD}}. \tag{10}$$

The limiting-case solutions are slug-test solutions, which suggest that a refracture-candidate diagnostic test may be analyzed as a slug test provided the injection time is short relative to the reservoir response.

Consequently, a refracture-candidate diagnostic test may use the following in certain embodiments:

Isolate a layer to be tested.

Inject liquid or gas at a pressure exceeding fracture initiation and propagation pressure. In certain embodiments, the injected volume may be roughly equivalent to the proppant-pack pore volume of an existing fracture if known or suspected to exist. In certain embodiments, the injection time may be limited to a few minutes.

Shut-in and record pressure falloff data. In certain embodiments, the measurement period may be several hours.

A qualitative interpretation may use the following steps:

Identify hydraulic fracture closure during the pressure falloff using methods such as those disclosed in Craig, D. P. et al., *Permeability, Pore Pressure, and Leakoff-Type Distributions in Rocky Mountain Basins*, SPE Production & Facilities, 48 (February, 2005).

The time at the end of pumping, $t_{ne}$, becomes the reference time zero, $\Delta t=0$. Calculate the shut-in time relative to the end of pumping as $$\Delta t = t - t_{ne} \tag{11}$$

In some cases, $t_{ne}$, is very small relative to t and $\Delta t=t$. As a person of ordinary skill in the art with the benefit of this disclosure will appreciate, $t_{ne}$ may be taken as zero approximately zero so as to approximate $\Delta t$. Thus, the term $\Delta t$ as used herein includes implementations where $t_{ne}$ is assumed to be zero or approximately zero. For a slightly-compressible fluid injection in a reservoir containing a compressible fluid, or a compressible fluid injection in a reservoir containing a compressible fluid, use the compressible reservoir fluid properties and calculate adjusted time as $$t_a = (\mu c_t)_{p0} \int_0^{\Delta t} \frac{d\Delta t}{(\mu c_t)_w} \tag{12}$$

where pseudotime may be defined as $$t_p = \int_0^t \frac{dt}{(\mu c_t)_w} \tag{13}$$

and adjusted time or normalized pseudotime may be defined as $$t_a = (\mu c_t)_{re} \int_0^t \frac{dt}{\mu_w c_t} \tag{14}$$

where the subscript 're' refers to an arbitrary reference condition selected for convenience.

The pressure difference for a slightly-compressible fluid injection into a reservoir containing a slightly compressible fluid may be calculated as $$\Delta p(t) = P_w(t) - P_i, \tag{15}$$

or for a slightly-compressible fluid injection in a reservoir containing a compressible fluid, or a compressible fluid injection in a reservoir containing a compressible fluid, use the compressible reservoir fluid properties and calculate the adjusted pseudopressure difference as $$\Delta P_a(t) = P_{aw}(t) - P_{ai}, \tag{16}$$

where $$p_a = \left(\frac{\mu z}{p}\right)_{p_i} \int_0^p \frac{p\,dp}{\mu z}. \tag{17}$$

where pseudopressure may be defined as $$p_a = \int_0^p \frac{p\,dp}{\mu z} \tag{18}$$

and adjusted pseudopressure or normalized pseudopressure may be defined as $$p_a = \left(\frac{\mu z}{p}\right)_{re} \int_0^p \frac{p\,dp}{\mu z} \tag{19}$$

where the subscript 're' refers to an arbitrary reference condition selected for convenience.

The reference conditions in the adjusted pseudopressure and adjusted pseudotime definitions are arbitrary and different forms of the solution can be derived by simply changing the normalizing reference conditions.

Calculate the pressure-derivative plotting function as $$\Delta p' = \frac{d(\Delta p)}{d(\ln \Delta t)} = \Delta p \Delta t, \tag{20}$$

or $$\Delta p'_a = \frac{d(\Delta p_a)}{d(\ln t_a)} = \Delta p_a t_a, \tag{21}$$

Transform the recorded variable-rate pressure falloff data to an equivalent pressure if the rate were constant by integrating the pressure difference with respect to time, which may be written for a slightly compressible fluid as $$I(\Delta p) = \int_0^{\Delta t} [p_w(\tau) - p_i] d\tau \tag{22}$$

or for a slightly-compressible fluid injected in a reservoir containing a compressible fluid, or a compressible fluid injection in a reservoir containing a compressible fluid, the pressure-plotting function may be calculated as $$I(\Delta p_a) = \int_0^{t_a} \Delta p_a dt_a. \tag{23}$$

Calculate the pressure-derivative plotting function as $$\Delta p' = \frac{d(\Delta p)}{d(\ln \Delta t)} = \Delta p \Delta t, \tag{24}$$

or $$\Delta p'_a = \frac{d(\Delta p_a)}{d(\ln t_a)} = \Delta p_a t_a, \tag{25}$$

Prepare a log-log graph of I(ΔP) versus Δt or I($\Delta P_a$) versus $t_a$.

Prepare a log-log graph of ΔP' versus Δt or $\Delta P'_a$ versus $t_a$.

Examine the storage behavior before and after closure.

II. Analysis and Interpretation of Data Generally

A change in the magnitude of storage at fracture closure suggests a fracture retaining residual width exists. When the storage decreases, an existing fracture is nondamaged. Conversely, a damaged fracture, or a fracture exhibiting choked-fracture skin, is indicated by apparent increase in the storage coefficient.

Quantitative refracture-candidate diagnostic interpretation uses type-curve matching, or if pseudoradial flow is observed, after-closure analysis as presented in Gu, H. et al., *Formation Permeability Determination Using Impulse-Fracture Injection*, SPE 25425 (1993) or Abousleiman, Y., Cheng, A. H-D. and Gu, H., *Formation Permeability Determination by Micro or Mini-Hydraulic Fracturing*, J. of Energy Resources Technology, 116, No. 6, 104 (June 1994). After-closure analysis is preferable because it does not require knowledge of fracture half length to calculate transmissibility. However, pseudoradial flow is unlikely to be observed during a relatively short pressure falloff, and type-curve matching may be necessary.

From a pressure match point on a constant-rate type curve with constant before-closure storage, transmissibility may be calculated in field units as $$\frac{kh}{\mu} = 141.2(24) p_{wsD}(0) C_{Lfbc}(p_0 - p_i) \left[ \frac{p_{LfbcD}(t_D)}{\int_0^{\Delta t} [p_w(\tau) - p_i] d\tau} \right]_M \tag{26}$$

or from an after-closure pressure match point using a variable-storage type curve $$\frac{kh}{\mu} = 141.2(24) \left[ \begin{matrix} p_{wsD}(0) C_{Lfbc-} \\ P_{wsD}((t_c)_{LfD})[C_{Lfbc} - C_{Lfbc}] \end{matrix} \right] (p_0 - p_i) \left[ \frac{p_{LfacD}(t_D)}{\int_0^{\Delta t} [p_w(\tau) - p_i] d\tau} \right]_M \tag{27}$$

Quantitative interpretation has two limitations. First, the average reservoir pressure must be known for accurate equivalent constant-rate pressure and pressure derivative calculations, Eqs. 22-25. Second, both primary and secondary fracture half lengths are required to calculate transmissibility. Assuming the secondary fracture half length can be estimated by imaging or analytical methods as presented in Valkó, P. P. and Economides, M. J., *Fluid-Leakoff Delineation in High Permeability Fracturing*, SPE Production & Facilities, 117 (May, 1999), the primary fracture half length is calculated from the type curve match, $L_{f1}=L_{f2}/\delta_L$. With both fracture half lengths known, the before-and after-closure storage coefficients can be calculated as in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) and the transmissibility estimated.

III. Theoretical Model A—Fracture-Injection/Falloff Solution in a Reservoir Without a Pre-Existing Fracture Assume a slightly compressible fluid fills the wellbore and fracture and is injected at a constant rate and at a pressure sufficient to create a new hydraulic fracture or dilate an existing fracture. A mass balance during a fracture injection may be written as $$\frac{m_{in}}{q_w B \rho} - \frac{m_{out}}{q_l B_r \rho_r} = \overbrace{V_{wb} \frac{d\rho_{wb}}{dt} + 2 \frac{d(V_f \rho_f)}{dt}}^{Storage}, \tag{A-1}$$

where $Q_l$ is the fluid leakoff rate into the reservoir from the fracture, $q_l=q_{sf}$, and $V_f$ is the fracture volume.

A material balance equation may be written assuming a constant density, $\rho=\rho_{wb}=\rho_f=\rho_r$, and a constant formation volume factor, $B=B_r$, as $$q_{sf} = q_w - \frac{1}{B}\left(c_{wb} V_{wb} + 2 c_f V_f + 2 \frac{dV_f}{dp_w}\right) \frac{dp_w}{dt}. \tag{A-3}$$

During a constant rate injection with changing fracture length and width, the fracture volume may be written as $$V_f(p_w(t)) = h_f L(p_w(t)) \hat{w}_f(p_w(t)) \tag{A-3}$$

and the propagating-fracture storage coefficient may be written as $$C_{pf}(p_w(t)) = c_{wb}V_{wb} + 2c_f V_f(p_w(t)) + 2\frac{dV_f(p_w(t))}{dp_w}. \quad \text{(A-4)}$$

The dimensionless wellbore pressure for a fracture-injection/falloff may be written as $$p_{wsD}(t_{LfD}) = \frac{p_w(t_{LfD}) - p_i}{p_0 - p_i}, \quad \text{(A-5)}$$

where $P_i$ is the initial reservoir pressure and $P_0$ is an arbitrary reference pressure. At time zero, the wellbore pressure is increased to the "opening" pressure, $P_{w0}$, which is generally set equal to $P_0$, and the dimensionless wellbore pressure at time zero may be written as $$p_{wsD}(0) = \frac{p_{w0} - p_i}{p_0 - p_i}. \quad \text{(A-6)}$$

Define dimensionless time as $$t_{LfD} = \frac{kt}{\phi\mu c_t L_f^2}, \quad \text{(A-7)}$$

where $L_f$ is the fracture half-length at the end of pumping. The dimensionless reservoir flow rate may be defined as $$q_{sD} = \frac{q_{sf}B\mu}{2\pi kh(p_0 - p_i)}, \quad \text{(A-8)}$$

and the dimensionless well flow rate may be defined as $$q_{wsD} = \frac{q_w B\mu}{2\pi kh(p_0 - p_i)}, \quad \text{(A-9)}$$

where $q_w$ is the well injection rate.

With dimensionless variables, the material balance equation for a propagating fracture during injection may be written as $$q_{sD} = q_{wsD} - \frac{C_{pf}(p_w(t))}{2\pi\phi c_t h L_f^2}\frac{dp_{wsD}}{dt_{LfD}}. \quad \text{(A-10)}$$

Define a dimensionless fracture storage coefficient as $$C_{fD} = \frac{C_{pf}(p_w(t))}{2\pi\phi c_t h L_f^2}, \quad \text{(A-11)}$$

and the dimensionless material balance equation during an injection at a pressure sufficient to create and extend a hydraulic fracture may be written as $$q_{sD} = q_{wsD} - C_{pfD}(p_{wsD}(t_{LfD}))\frac{dp_{wsD}}{dt_{LfD}}. \quad \text{(A-12)}$$

Using the technique of Correa and Ramey as disclosed in Correa, A. C. and Ramey, H. J., Jr., *Combined Effects of Shut-In and Production: Solution With a New Inner Boundary Condition*, SPE 15579 (1986) and Correa, A. C. and Ramey, H. J., Jr., *A Method for Pressure Buildup Analysis of Drillstem Tests*, SPE 16802 (1987), a material balance equation valid at all times for a fracture-injection/falloff sequence with fracture creation and extension and constant after-closure storage may be written as $$\begin{aligned} q_{sD} = {} & q_{wsD} - U_{(t_e)_{LfD}} q_{wsD} - C_{pfD}(p_{wsD}(t_{LfD}))\frac{dp_{wsD}}{dt_{LfD}} + \\ & U_{(t_e)_{LfD}}[C_{pfD}(p_{wsD}(t_{LfD})) - C_{bcD}]\frac{dp_{wsD}}{dt_{LfD}} + \\ & U_{(t_c)_{LfD}}[C_{bcD} - C_{acD}]\frac{dp_{wsD}}{dt_{LfD}} \end{aligned} \quad \text{(A-13)}$$

where the unit step function is defined as $$U_a = \begin{cases} 0, & t < a \\ 1, & t > a \end{cases}. \quad \text{(A-14)}$$

The Laplace transform of the material balance equation for an injection with fracture creation and extension is written after expanding and simplifying as $$\begin{aligned} \bar{q}_{sD} = {} & \frac{q_{wsD}}{s} - q_{wsD}\frac{e^{-s(t_e)_{LfD}}}{s} - \\ & \int_0^{(t_e)_{LfD}} e^{-st_{LfD}} C_{pfD}(p_{wsD}(t_{LfD}))p'_{wsD}(t_{LfD})dt_{LfD} - \\ & sC_{acD}\bar{p}_{wsD} + p_{wsD}(0)C_{acD} + \\ & \int_0^{(t_e)_{LfD}} e^{-st_{LfD}} C_{bcD}p'_{wsD}(t_{LfD})dt_{LfD} - \\ & (C_{bcD} - C_{acD})\int_0^{(t_c)_{LfD}} e^{-st_{LfD}} p'_{wsD}(t_{LfD})dt_{LfD} \end{aligned} \quad \text{(A-15)}$$

With fracture half length increasing during the injection, a dimensionless pressure solution may be required for both a propagating and fixed fracture half-length. A dimensionless pressure solution may developed by integrating the line-source solution, which may be written as $$\overline{\Delta p}_{ls} = \frac{\tilde{q}\mu}{2\pi ks}K_0(r_D\sqrt{u}), \quad \text{(A-16)}$$

from $x_w - \bar{L}(s)$ and $x_w + \bar{L}(s)$ with respect to $x'_w$ where $u = sf(s)$, and $f(s) = 1$ for a single-porosity reservoir. Here, it is assumed that the fracture half length may be written as a function of the Laplace variable, s, only. In terms of dimensionless variables, $x'_{wD}=x'_w/L_f$ and $dx'_w=L_f dx'_{wD}$, the line-source solution is integrated from $x_{wD}-\bar{L}_{fD}(s)$ to $x_{wD}+\bar{L}_{fD}(s)$, which may be written as $$\overline{\Delta p} = \frac{\tilde{q}\mu L_f}{2\pi ks}\int_{x_{wD}-L_{fD}(s)}^{x_{wD}+L_{fD}(s)} K_0\left[\sqrt{u}\sqrt{(x_D-x'_{wD})^2+(y_D-y_{wD})^2}\right]dx'_{wD} \tag{A-17}$$

Assuming that the well center is at the origin, $x_{wD}=Y_{wD}=0$, $$\overline{\Delta p} = \frac{\tilde{q}\mu L_f}{2\pi ks}\int_{-L_{fD}(s)}^{L_{fD}(s)} K_0\left[\sqrt{u}\sqrt{(x_D-x'_{wD})^2+(y_D)^2}\right]dx'_{wD} \tag{A-18}$$

Assuming constant flux, the flow rate in the Laplace domain may be written as $$\bar{q}(s)=2\tilde{q}h\bar{L}(s), \tag{A-19}$$

and the plane-source solution may be written in dimensionless terms as $$\bar{p}_D = \frac{\bar{q}_D(s)}{\bar{L}_{fD}(s)}\frac{1}{2s}\int_{-L_{fD}(s)}^{L_{fD}(s)} K_0\left[\sqrt{u}\sqrt{(x_D-\alpha)^2+(y_D)^2}\right]d\alpha, \tag{A-20}$$

where $$\bar{p}_D = \frac{2\pi kh\overline{\Delta p}}{\bar{q}\mu}, \tag{A-21}$$

$$\bar{L}_{fD}(s) = \frac{L(s)}{L_f}, \tag{A-22}$$

and defining the total flow rate as $\bar{q}_t(s)$, the dimensionless flow rate may be written as $$\bar{q}_D(s) = \frac{\bar{q}(s)}{\bar{q}_t(s)}. \tag{A-23}$$

It may be assumed that the total flow rate increases proportionately with respect to increased fracture half-length such that $\bar{q}_D(s)=1$. The solution is evaluated in the plane of the fracture, and after simplifying the integral using the identity of Ozkan and Raghavan as disclosed in Ozkan, E. and Raghavan, R., *New Solutions for Well-Test-Analysis Problems: Part 2—Computational Considerations and Applications*, SPEFE, 369 (September, 1991), the dimensionless uniform-flux solution in the Laplace domain for a variable fracture half-length may be written as $$\bar{p}_{pfD} = \frac{1}{\bar{L}_{fD}(s)}\frac{1}{2s\sqrt{u}}\left[\int_0^{\sqrt{u}(L_{fD}(s)+x_D)} K_0[z]dz + \int_0^{\sqrt{u}(L_{fD}(s)-x_D)} K_0[z]dz\right] \tag{A-24}$$

and the infinite conductivity solution may be obtained by evaluating the uniform-flux solution at $x_D=0.732\bar{L}_{fD}(s)$ and may be written as $$\bar{p}_{pfD} = \frac{1}{\bar{L}_{fD}(s)}\frac{1}{2s\sqrt{u}}\left[\int_0^{\sqrt{u}\,L_{fD}(s)(1+0.732)} K_0[z]dz + \int_0^{\sqrt{u}\,L_{fD}(s)(1-0.732)} K_0[z]dz\right] \tag{A-25}$$

The Laplace domain dimensionless fracture half-length varies between 0 and 1 during fracture propagation, and using a power-model approximation as shown in Nolte, K. G., *Determination of Fracture Parameters From Fracturing Pressure Decline*, SPE 8341 (1979), the Laplace domain dimensionless fracture half-length may be written as $$\bar{L}_{fD}(s) = \frac{\bar{L}(s)}{\bar{L}_f(s_e)} = \left(\frac{s_e}{s}\right)^{\alpha}, \tag{A-26}$$

where $s_e$ is the Laplace domain variable at the end of pumping. The Laplace domain dimensionless fracture half length may be written during propagation and closure as $$\bar{L}_{fD}(s) = \begin{cases}\left(\frac{s_e}{s}\right)^{\alpha} & s_e < s \\ 1 & s_e \geq s\end{cases}. \tag{A-27}$$

where the power-model exponent ranges from $\alpha=½$ for a low efficiency (high leakoff) fracture and $\alpha=1$ for a high efficiency (low leakoff) fracture.

During the before-closure and after-closure period—when the fracture half-length is unchanging—the dimensionless reservoir pressure solution for an infinite conductivity fracture in the Laplace domain may be written as $$\bar{p}_{fD} = \frac{1}{2s\sqrt{u}}\left[\int_0^{\sqrt{u}(1+0.732)} K_0[z]dz + \int_0^{\sqrt{u}(1-0.732)} K_0[z]dz\right]. \tag{A-28}$$

The two different reservoir models, one for a propagating fracture and one for a fixed-length fracture, may be superposed to develop a dimensionless wellbore pressure solution by writing the superposition integrals as $$p_{wsD} = \int_0^{t_{LfD}} q_{pfD}(\tau_D)\frac{dp_{pfD}(t_{LfD}-\tau_D)}{dt_{LfD}}d\tau_D + \int_0^{t_{LfD}} q_{fD}(\tau_D)\frac{dp_{fD}(t_{LfD}-\tau_D)}{dt_{LfD}}d\tau_D, \tag{A-29}$$

where $q_{pfD}(t_{LfD})$ is the dimensionless flow rate for the propagating fracture model, and $q_{fD}(t_{LfD})$ is the dimensionless flow rate with a fixed fracture half-length model used during the before-closure and after-closure falloff period. The initial condition in the fracture and reservoir is a constant initial pressure, $p_D(t_{LfD})=p_{pfD}(t_{LfD})=p_{fD}(t_{LfD})=0$, and with condition, the Laplace transform of the superposition integral is written as $$\bar{p}_{wsD}=\bar{q}_{pfD}s\bar{p}_{pfD}+\bar{q}_{fD}s\bar{p}_{fD} \tag{A-30}$$

The Laplace domain dimensionless material balance equation may be split into injection and falloff parts by writing as $$\bar{q}_{sD}=\bar{q}_{pfD}+\bar{q}_{fD}, \tag{A-31}$$

where the dimensionless reservoir flow rate during fracture propagation may be written as $$\bar{q}_{pfD}=\frac{q_{wsD}}{s}-q_{wsD}\frac{e^{-s(t_e)_{LfD}}}{s}-\int_0^{(t_e)_{LfD}}e^{-st_{LfD}}C_{pfD}(p_{wsD}(t_{LfD}))p'_{wsD}(t_{LfD})dt_{LfD}, \tag{A-32}$$

and the dimensionless before-closure and after-closure fracture flow rate may be written as $$\bar{q}_{fD}=\begin{bmatrix} p_{wD}(0)C_{acD}-sC_{acD}\bar{p}_{wsD}+C_{bcD} \\ \int_0^{(t_e)_{LfD}}e^{-st_{LfD}}p'_{wsD}(t_{LfD})dt_{LfD}-(C_{bcD}-C_{acD}) \\ \int_0^{(t_c)_{LfD}}e^{-st_{LfD}}p'_{wsD}(t_{LfD})dt_{LfD} \end{bmatrix}. \tag{A-33}$$

Using the superposition principle to develop a solution requires that the pressure-dependent dimensionless propagating-fracture storage coefficient be written as a function of time only. Let fracture propagation be modeled by a power model and written as $$\frac{A(t)}{A_f}=\frac{h_fL(t)}{h_fL_f}=\left(\frac{t}{t_e}\right)^{\alpha}. \tag{A-34}$$

Fracture volume as a function of time may be written as $$V_f(p_w(t))=h_fL(p_w(t))\hat{w}_f(p_w(t)) \tag{A-35}$$

which, using the power model, may also be written as $$V_f(p_w(t))=h_fL_f\frac{(p_w(t)-p_c)}{S_f}\left(\frac{t}{t_e}\right)^{\alpha}. \tag{A-36}$$

The derivative of fracture volume with respect to wellbore pressure may be written as $$\frac{dV_f(p_w(t))}{dp_w}=\frac{h_fL_f}{S_f}\left(\frac{t}{t_e}\right)^{\alpha}. \tag{A-37}$$

Recall the propagating-fracture storage coefficient may be written as $$C_{pf}(p_w(t))=c_{wb}V_{wb}+2c_fV_f(p_w(t))+2\frac{dV_f(p_w(t))}{dp_w}, \tag{A-38}$$

which, with power-model fracture propagation included, may be written as $$C_{pf}(p_w(t))=c_{wb}V_{wb}+2\frac{h_fL_f}{S_f}\left(\frac{t}{t_e}\right)^{\alpha}(c_fp_n+1). \tag{A-39}$$

As noted by Hagoort, J., *Waterflood-induced hydraulic fracturing*, PhD Thesis, Delft Tech. Univ. (1981), Koning, E. J. L. and Niko, H., *Fractured Water-Injection Wells: A Pressure Falloff Test for Determining Fracturing Dimensions*, SPE 14458 (1985), Koning, E. J. L., *Waterflooding Under Fracturing Conditions*, PhD Thesis, Delft Technical University (1988), van den Hoek, P. J., *Pressure Transient Analysis in Fractured Produced Water Injection Wells*, SPE 77946 (2002), and van den Hoek, P. J., *A Novel Methodology to Derive the Dimensions and Degree of Containment of Waterflood-Induced Fractures From Pressure Transient Analysis*, SPE 84289 (2003), $c_fp_n(t)\square 1$, and the propagating-fracture storage coefficient may be written as $$C_{pf}(t_{LfD})=c_{wb}V_{wb}+2\frac{A_f}{S_f}\left(\frac{t_{LfD}}{(t_e)_{LfD}}\right)^{\alpha}, \tag{A-40}$$

which is not a function of pressure and allows the superposition principle to be used to develop a solution.

Combining the material balance equations and superposition integrals results in $$\begin{aligned} p_{wsD}= & \\ & q_{wsD}\bar{p}_{pfD}-q_{wsD}\bar{p}_{pfD}e^{-s(t_e)_{LfD}}-C_{acD}[s\bar{p}_{fD}(s\bar{p}_{wsD}-p_{wD}(0))]- \\ & s\bar{p}_{pfD}\int_0^{(t_e)_{LfD}}e^{-st_{LfD}}C_{pfD}(t_{LfD})p'_{wsD}(t_{LfD})dt_{LfD}+ \\ & s\bar{p}_{fD}C_{bcD}\int_0^{(t_e)_{LfD}}e^{-st_{LfD}}p'_{wsD}(t_{LfD})- \\ & s\bar{p}_{fD}\int_0^{(t_c)_{LfD}}e^{-st_{LfD}}[C_{bcD}-C_{acD}]p'_{wsD}(t_{LfD})dt_{LfD} \end{aligned} \tag{A-41}$$

and after inverting to the time domain, the fracture-injection/falloff solution for the case of a propagating fracture, constant before-closure storage, and constant after-closure storage may be written as $$\begin{aligned} p_{wsD}(t_{LfD})= & q_{wsD}[p_{pfD}(t_{LfD})-p_{pfD}(t_{LfD}-(t_e)_{LfD})]- \\ & C_{acD}\int_0^{t_{LfD}}p'_{fD}(t_{LfD}-\tau_D)p'_{wsD}(\tau_D)d\tau_D- \\ & \int_0^{(t_e)_{LfD}}p'_{pfD}(t_{LfD}-\tau_D)C_{pfD}(\tau_D)p'_{wsD}(\tau_D)d\tau_D+ \\ & C_{bcD}\int_0^{(t_e)_{LfD}}p'_{fD}(t_{LfD}-\tau_D)p'_{wsD}(\tau_D)d\tau_D- \\ & (C_{bcD}-C_{acD})\int_0^{(t_C)_{LfD}}p'_{fD}(t_{LfD}-\tau_D)p'_{wsD}(\tau_D)d\tau_D \end{aligned} \tag{A-42}$$

Limiting-case solutions may be developed by considering the integral term containing propagating-fracture storage. When, $t_{LfD}\square(t_e)_{LfD}$, the propagating-fracture solution derivative may be written as $$p'_{pfD}(t_{LfD}-\tau_D)\cong p'_{pfD}(t_{LfD}), \tag{A-43}$$

and the fracture solution derivative may also be approximated as $$p'_{fD}(t_{LfD}-\tau_D)\cong p'_{fD}(t_{LfD}) \tag{A-44}$$

The definition of the dimensionless propagating-fracture solution states that when $t_{LfD}>(t_e)_{LfD}$, the propagating-fracture and fracture solution are equal, and $p'_{pfD}(t_{LfD})=p'_{fD}(t_{LfD})$. Consequently, for $t_{LfD}\square(t_e)_{LfD}$, the dimensionless wellbore pressure solution may be written as $$p_{wsD}(t_{LfD}) = \begin{bmatrix} p'_{fD}(t_{LfD})\int_0^{(t_e)_{LfD}}[C_{bcD}-C_{fD}(\tau_D)]p'_{wsD}(\tau_D)d\tau_D - \\ C_{acD}\int_0^{t_{LfD}} p'_{fD}(t_{LfD}-\tau_D)p'_{wsD}(\tau_D)d\tau_D - \\ (C_{bcD}-C_{acD})\int_0^{(t_C)_{LfD}} p'_{fD}(t_{LfD}-\tau_D)p'_{wsD}(\tau_D)d\tau_D \end{bmatrix} \tag{A-45}$$

The before-closure storage coefficient is by definition always greater than the propagating-fracture storage coefficient, and the difference of the two coefficients cannot be zero unless the fracture half-length is created instantaneously. However, the difference is also relatively small when compared to $C_{bcD}$ or $C_{acD}$, and when the dimensionless time of injection is short and $t_{LfD}>(t_e)_{LfD}$, the integral term containing the propagating-fracture storage coefficient becomes negligibly small.

Thus, with a short dimensionless time of injection and $(t_e)_{LfD}\square t_{LfD}<(t_c)_{LfD}$, the limiting-case before-closure dimensionless wellbore pressure solution may be written as $$p_{wsD}(t_{LfD}) = p_{wsD}(0)C_{acD}p'_{acD}(t_{LfD}) - (C_{bcD}-C_{acD})\int_0^{t_{LfD}} p'_{acD}(t_{LfD}-\tau_D)p'_{wsD}(\tau_D)d\tau_D \tag{A-46}$$

which may be simplified in the Laplace domain and inverted back to the time domain to obtain the before-closure limiting-case dimensionless wellbore pressure solution written as $$p_{wsD}(t_{LfD})=p_{wsD}(0)C_{bcD}p'_{bcD}(t_{LfD}), \tag{A-47}$$

which is the slug test solution for a hydraulically fractured well with constant before-closure storage.

When the dimensionless time of injection is short and $t_{LfD}\square(t_c)_{LfD}\square(t_e)_{LfD}$, the fracture solution derivative may be approximated as $$p'_{fD}(t_{LfD}-\tau_D)\cong p'_{fD}(t_{LfD}), \tag{A-48}$$

and with $t_{LfD}\square(t_c)_{LfD}$ and $p'_{acD}(t_{LfD}-\tau_D)\cong p'_{acD}(t_{LfD})$, the dimensionless wellbore pressure solution may written as $$p_{wsD}(t_{LfD})=[p_{wsD}(0)C_{bcD}-p_{wsD}((t_c)_{LfD})(C_{bcD}-C_{acD})]p'_{acD}(t_{LfD}) \tag{A-49}$$

Figure 4:
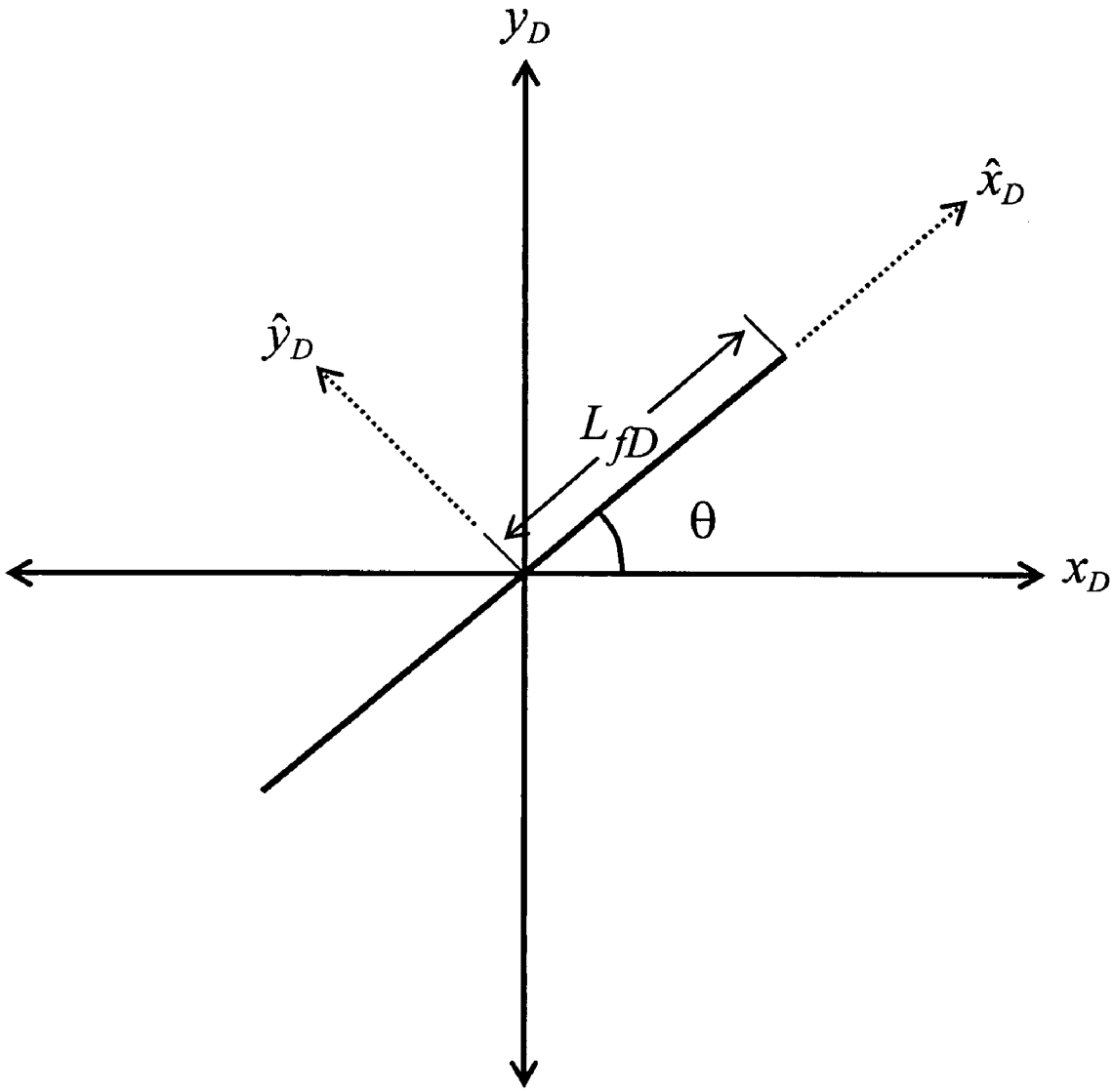
FIG. 4 shows an infinite-conductivity fracture at an arbitrary angle from the $x_D$ axis.

IV. Theoretical Model B—Analytical Pressure-Transient Solution for a Well Containing Multiple Infinite-Conductivity Vertical Fractures in an Infinite Slab Reservoir FIG. 4 illustrates a vertical fracture at an arbitrary angle, θ, from the $x_D$-axis. The uniform-flux plane-source solution assuming an isotropic reservoir may be written in the Laplace domain as presented in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) as $$\bar{p}_D = \frac{1}{2sL_{fD}}\int_{-L_{fD}}^{L_{fD}} K_0\left[\sqrt{u}\sqrt{(\hat{x}_D-\alpha)^2+(\hat{y}_D)^2}\right]d\alpha \tag{B-1}$$

where dimensionless variables are defined as $$r_D=\sqrt{x_D^2+y_D^2}, \tag{B-2}$$

$$x_D=r_D\cos\theta_r, \tag{B-3}$$

$$y_D=r_D\sin\theta_r, \tag{B-4}$$

$$\hat{x}_D=x_D\cos\theta_f+y_D\sin\theta_f, \tag{B-5}$$

$$\hat{y}_D=y_D\cos\theta_f-x_D\sin\theta_f, \tag{B-6}$$

and $\theta_f$ is the angle between the fracture and the $x_D$-axis, $(r_D, \theta_r)$ are the polar coordinates of a point $(x_D,y_D)$, and $(\alpha,\theta_f)$are the polar coordinates of a point along the fracture as disclosed in Ozkan, E., Yildiz, T., and Kuchuk, F. J., *Transient Pressure Behavior of Duallateral Wells*, SPE 38760 (1997). Combining Eqs. B-3 through B-6 results in $$\hat{x}_D=r_D\cos(\theta_r-\theta_f), \tag{B-7}$$

and $$\hat{y}_D=r_D\sin(\theta_r-\theta_f) \tag{B-8}$$

Consequently, the Laplace domain plane-source solution for a fracture rotated by an angle $\theta_f$ from a point $(r_D, \theta_r)$ may be written as $$\bar{p}_D = \frac{\bar{q}_D}{2sL_{fD}}\int_{-L_{fD}}^{L_{fD}} K_0\left[\sqrt{u}\sqrt{[r_D\cos(\theta_r-\theta_f)-\alpha]^2+r_D^2\sin^2(\theta_r-\theta_f)}\right]d\alpha \tag{B-9}$$

For a well containing $n_f$fractures connected at the well bore, the total flow rate from the well assuming all production is through the fractures may be written as $$\sum_{i=1}^{n_f} q_{iD} = 1, \tag{B-10}$$

where $q_{iD}$ is the dimensionless flow rate for the $i^{th}$-fracture defined as $$q_{iD} = \frac{q_i}{q_w} = \frac{q_i}{\sum_{k=1}^{n_f} q_k}, \tag{B-11}$$

and $q_i$ is the flow rate from the $i^{th}$-fracture.

The dimensionless pressure solution is obtained by superposing all fractures as disclosed in Raghavan, R., Chen, C-C, and Agarwal, B., *An Analysis of Horizontal Wells Intercepted by Multiple Fractures*, SPEJ 235 (September, 1997) and written using the superposition integral as $$p_{LfD} = (p_{wD})_\ell = \sum_{i=1}^{n_f} \int_0^{t_{LfD}} q_{iD}(\tau_D)(p'_D)_{\ell i}(t_{LfD} - \tau_D)d\tau_D, \quad \ell = 1, 2, \ldots, n_f \tag{B-12}$$

where the pressure derivative accounts for the effects of fracture i on fracture l.

The Laplace transform of the dimensionless rate equation may be written as $$\sum_{i=1}^{n_f} \bar{q}_{iD} = \frac{1}{s}, \tag{B-13}$$

and with the initial condition, $P_D$ ($t_{LfD}$=0)=0, the Laplace transform of the dimensionless pressure solution may be written as $$(\bar{p}_{wD})_\ell = \sum_{i=1}^{n_f} s\bar{q}_{iD}(\bar{p}_D)_{\ell i}, \quad \ell = 1, 2, \ldots, n_f, \tag{B-14}$$

where $(\bar{P}_D)_{li}$ is the Laplace domain uniform-flux solution for a single fracture written to account for the effects of multiple fractures as $$(\bar{p}_D)_{\ell i} = \frac{1}{2sL_{f_iD}} \int_{-L_{f_iD}}^{L_{f_iD}} K_0\left[\sqrt{u}\sqrt{[r_D\cos(\theta_\ell - \theta_i) - \alpha]^2 + r_D^2\sin^2(\theta_\ell - \theta_i)}\right]d\alpha \tag{B-15}$$

The uniform-flux Laplace domain multiple fracture solution may now be written as $$(\bar{p}_{wD})_\ell = \sum_{i=1}^{n_f} \frac{\bar{q}_{iD}}{2L_{f_iD}} \int_{-L_{f_iD}}^{L_{f_iD}} K_0\left[\sqrt{u}\sqrt{[r_D\cos(\theta_\ell - \theta_i) - \alpha]^2 + r_D^2\sin^2(\theta_\ell - \theta_i)}\right]d\alpha \quad \ell = 1, 2, \ldots, n_f. \tag{B-16}$$

A semianalytical multiple arbitrarily-oriented infinite-conductivity fracture solution can be developed in the Laplace domain. If flux is not uniform along the fracture(s), a solution may be written using superposition that accounts for the effects of multiple fractures as $$(\bar{p}_{wD})_\ell = \sum_{i=1}^{n_f} \frac{1}{2L_{f_iD}} \int_{-L_{f_iD}}^{L_{f_iD}} \bar{q}_{iD}(\alpha, s)K_0\left[\sqrt{u}\sqrt{[r_{iD}\cos(\theta_\ell - \theta_i) - \alpha]^2 + r_{iD}^2\sin^2(\theta_\ell - \theta_i)}\right]d\alpha \tag{B-17}$$

where l=1,2, . . . , $n_f$. If a point ($r_{iD}$, $\theta_i$)is restricted to a point along the $i^{th}$ fracture axis, then the reference and fracture axis are the same and Eq. B-7 results in $$\hat{x}_{iD} = r_{iD}\cos(\theta_i - \theta_i) = r_{iD}, \tag{B-18}$$

and the multiple fracture solution may be written as $$(\bar{p}_{wD})_\ell = \sum_{i=1}^{n_f} \frac{1}{2L_{f_iD}} \int_{-L_{f_iD}}^{L_{f_iD}} \bar{q}_{iD}(\alpha, s)K_0\left[\sqrt{u}\sqrt{[\hat{x}_{iD}\cos(\theta_\ell - \theta_i) - \alpha]^2 + \hat{x}_{iD}^2\sin^2(\theta_\ell - \theta_i)}\right]d\alpha \quad \ell = 1, 2, \ldots, n_f \tag{B-19}$$

Assuming each fracture is homogeneous and symmetric, that is, $\bar{q}_{iD}(\alpha, s) = \bar{q}_{iD}(-\alpha, s)$, the multiple infinite-conductivity fracture solution for an isotropic reservoir may be written as $$(\bar{p}_{wD})_\ell = \sum_{i=1}^{n_f} \frac{1}{2L_{f_iD}} \int_0^{L_{f_iD}} \bar{q}_{iD}(x', s)\left[K_0\left[\sqrt{u}\sqrt{[(\hat{x}_{iD})\cos(\theta_\ell - \theta_i) - x']^2 + (\bar{x}_{iD})^2\sin^2(\theta_\ell - \theta_i)}\right] + K_0\left[\sqrt{u}\sqrt{[(\hat{x}_{iD})\cos(\theta_\ell - \theta_i) + x']^2 + (\hat{x}_{iD})^2\sin^2(\theta_\ell - \theta_i)}\right]\right]dx' \quad \ell = 1, 2, \ldots, n_f \tag{B-20}$$

A semianalytical solution for the multiple infinite-conductivity fracture solution is obtained by dividing each fracture into $n_{fs}$ equal segments of length, $\Delta\hat{x}_{iD} = L_{f,D}/n_{fs}$, and assuming constant flux in each segment. Although the number of segments in each fracture is the same, the segment length may be different for each fracture, $\Delta\hat{x}_{iD} \neq \Delta\hat{x}_{jD}$. With the discretization, the multiple infinite-conductivity fracture solution in the Laplace domain for an isotropic reservoir may be written as $$(\overline{p}_{wD})_\ell = \sum_{i=1}^{n_f}\sum_{m=1}^{n_{fs}} \frac{(\overline{q}_{iD})m}{2L_{f_iD}} \int_{[\hat{x}_{iD}]_m}^{[\hat{x}_{iD}]_{m+1}} \left[ K_0\left[\sqrt{u}\sqrt{[(\hat{x}_{iD})_j\cos(\theta_\ell-\theta_i)-x']^2+(\hat{x}_{iD})_j^2\sin^2(\theta_\ell-\theta_i)}\right] + K_0\left[\sqrt{u}\sqrt{[(\hat{x}_{iD})_j\cos(\theta_\ell-\theta_i)+x']^2+(\hat{x}_{iD})_j^2\sin^2(\theta_\ell-\theta_i)}\right]\right] dx'$$

$$\ell = 1, 2, \ldots, n_f \text{ and } j = 1, 2, \ldots, n_{fs} \tag{B-21}$$

A multiple infinite-conductivity fracture solution considering permeability anisotropy in an infinite slab reservoir is developed by defining the dimensionless distance variables as presented by Ozkan, E. and Raghavan, R., *New Solutions for Well-Test-Analysis Problems*: Part 1—*Analytical Considerations*, SPEFE, 359 (September, 1991) as $$x_D = \frac{x}{L}\sqrt{\frac{k}{k_x}}, \tag{B-22}$$

$$y_D = \frac{y}{L}\sqrt{\frac{k}{k_y}}, \tag{B-23}$$

and $$k = \sqrt{k_x k_y}. \tag{B-24}$$

The dimensionless variables rescale the anisotropic reservoir to an equivalent isotropic system. As a result of the resealing, the dimensionless fracture half-length changes and should be redefined as presented by Spivey, J. P. and Lee, W. J., *Estimating the Pressure-Transient Response for a Horizontal or a Hydraulically Fractured Well at an Arbitrary Orientation in an Aniostropic Reservoir*, SPE RESERVOIR EVAL. & ENG. (October, 1999) as $$L'_{f_iD} = \frac{L_{f_i}}{L}\sqrt{\frac{k}{k_x}\cos^2\theta_f + \frac{k}{k_y}\sin^2\theta_f}, \tag{B-25}$$

where the angle of the fracture with respect to the rescaled XD-axis may be written as $$\theta'_f = \tan^{-1}\left(\sqrt{\frac{k_x}{k_y}}\tan\theta_f\right), \quad 0 < \theta_f < \frac{\pi}{2}. \tag{B-26}$$

When $\theta_f=0$ or $\theta_f=\pi/2$, the angle does not rescale and $\theta'_f=\theta_f$.

With the redefined dimensionless variables, the multiple finite-conductivity fracture solution considering permeability anisotropy may be written as $$(\overline{p}_{wD})_\ell = \sum_{i=1}^{n_f}\frac{1}{2L_{f_iD}}\int_0^{L'_{f_iD}} \overline{q}_{iD}(x', s)\left[K_0\left[\sqrt{u}\sqrt{[(\hat{x}_{iD})\cos(\theta'_\ell-\theta'_i)-x']^2+(\hat{x}_{iD})^2\sin^2(\theta'_\ell-\theta'_i)}\right] + K_0\left[\sqrt{u}\sqrt{[(\hat{x}_{iD})\cos(\theta'_\ell-\theta'_i)-x']^2+(\hat{x}_{iD})^2\sin^2(\theta'_\ell-\theta'_i)}\right]\right] dx'$$

$$\ell = 1, 2, \ldots, n_f \tag{B-27}$$

where the angle, θ', is defined in the rescaled equivalent isotropic reservoir and is related to the anisotropic reservoir by $$\theta' = \begin{cases} \theta & \theta = 0 \\ \tan^{-1}\left(\sqrt{\frac{k_x}{k_y}}\tan\theta\right) & 0 < \theta < \pi/2 \\ \theta & \theta = \pi/2 \end{cases} \tag{B-28}$$

A semianalytical multiple arbitrarily-oriented infinite-conductivity fracture solution for an anisotropic reservoir may be written in the Laplace domain as $$(\overline{p}_{wD})_\ell = \sum_{i=1}^{n_f}\sum_{m=1}^{n_{fs}} \frac{(\overline{q}_{iD})_m}{2L'_{f_iD}} \int_{[\hat{x}_{iD}]_m}^{[\hat{x}_{iD}]_{m+1}} \left[ K_0\left[\sqrt{u}\sqrt{[(\hat{x}_{iD})\cos(\theta'_\ell-\theta'_i)-x']^2+(\hat{x}_{iD})_j^2\sin^2(\theta'_\ell-\theta'_i)}\right] + K_0\left[\sqrt{u}\sqrt{[(\hat{x}_{iD})_j\cos(\theta'_\ell-\theta'_i)-x']^2+(\hat{x}_{iD})_j^2\sin^2(\theta'_\ell-\theta'_i)}\right]\right] dx'$$

$$\ell = 1, 2, \ldots, n_f \text{ and } j = 1, 2, \ldots, n_{fs}, \tag{B-29}$$

with the Laplace domain dimensionless total flow rate defined by $$\sum_{i=1}^{n_f} \Delta\hat{x}_{iD} \sum_{m=1}^{n_{fs}} (\bar{q}_{iD})_m = \frac{1}{s}, \tag{B-30}$$

and an equation relating the dimensionless pressure at the well bore for each fracture written as $$(\bar{P}_{wD})_1 = (\bar{P}_{wD})_2 = \ldots = (\bar{P}_{wD})_{nf} = \bar{P}_{LfD} \tag{B-31}$$

For each fracture divided into $n_{fs}$f, equal length uniform-flux segments, Eqs. B-29 through B-31 describe a system of $n_f n_{fs}+2$ equations and $n_f n_{fs}+2$ unknowns. Solving the system of equations requires writing an equation for each fracture segment, which is demonstrated in below in Section V for multiple finite-conductivity fractures. The system of equations are solved in the Laplace domain and inverted to the time domain to obtain the dimensionless pressure using the Stehfest algorithm as presented by Stehfest, H., *Numerical Inversion of Laplace Transforms*, COMMUNICATIONS OF THE ACM, 13, No. 1, 47-49 (January, 1970).

Figure 5:
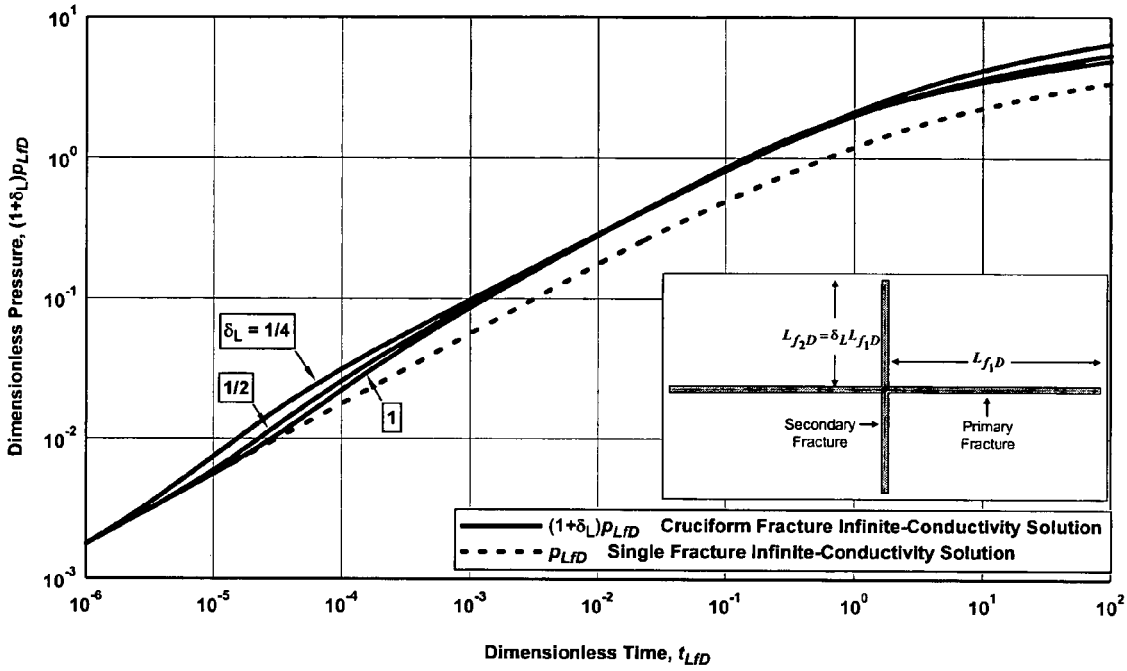
FIG. 5 shows a log-log graph of dimensionless pressure versus dimensionless time for an infinite-conductivity cruciform fracture with $\delta_L=\{0, ¼, ½, \text{and } 1\}$.

FIG. 5 contains a log-log graph of dimensionless pressure versus dimensionless time for a single infinite-conductivity fracture and a graph of the product of $(1+\delta_L)$ and dimensionless pressure for a cruciform infinite-conductivity fracture where the angle between the fractures is $\pi/2$. In FIG. 5, the inset graphic illustrates a cruciform fracture with primary fracture half length, $L_{f_1D}$, and the secondary fracture half length is defined by the ratio of secondary to primary fracture half length, $\delta_L = L_{f_1D}/L_{f_1D}$, where in FIG. 5, $\delta_L=1$. FIG. 5 illustrates that at very early dimensionless times, all curves overlay, but as interference effects are observed in the cruciform fractures, the single and cruciform fracture solutions diverge.

Figure 6:
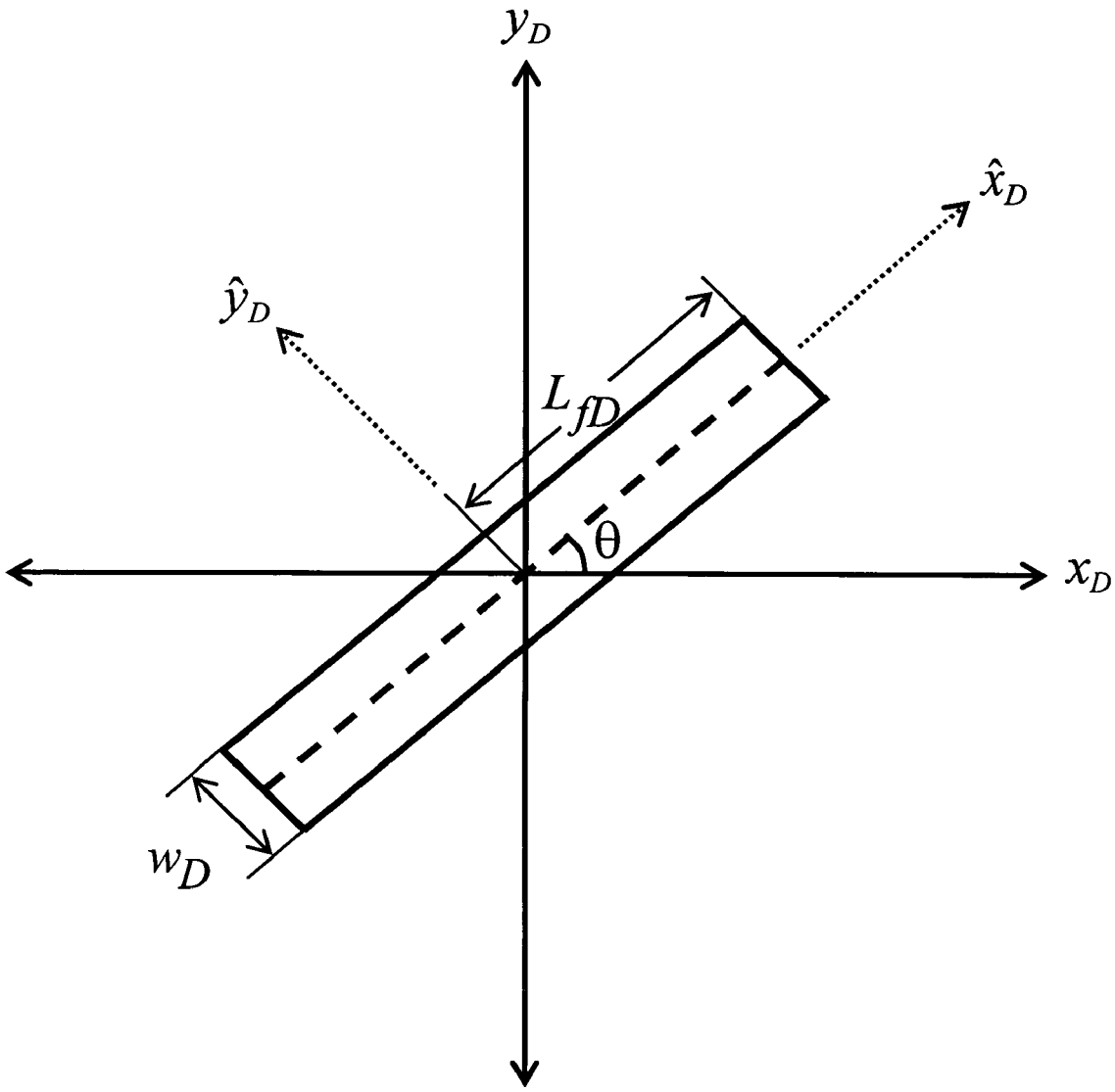
FIG. 6 shows a finite-conductivity fracture at an arbitrary angle from the $X_D$ axis.

V. Theoretical Model C—Analytical Pressure-Transient Solution for a Well Containing Multiple Finite-Conductivity Vertical Fractures in an Infinite Slab Reservoir The development of a multiple finite-conductivity vertical fracture solution requires writing a general solution for a finite-conductivity vertical fracture at any arbitrary angle, θ, from the $x_D$-axis. The development then follows from the semi-analytical finite-conductivity solutions of Cinco-L., H., Samaniego-V, F., and Dominguez-A, F., *Transient Pressure Behavior for a Well With a Finite-Conductivity Vertical Fracture*, SPEJ, 253 (August, 1978) and, for the dual-porosity case, Cinco-Ley, H. and Samaniego-V., F., *Transient Pressure Analysis: Finite Conductivity Fracture Case Versus Damage Fracture Case*, SPE 10179 (1981). FIG. 6 illustrates a vertical finite-conductivity fracture at an angle, θ, from the $x_D$-axis in an isotropic reservoir.

A finite-conductivity solution requires coupling reservoir and fracture-flow components, and the solution assumes

- The fracture is modeled as a homogeneous slab porous medium with fracture half-length, $L_f$, fracture width, $W_f$, and fully penetrating across the entire reservoir thickness, h.
- Fluid flow into the fracture is along the fracture length and no flow enters through the fracture tips.
- Fluid flow in the fracture is incompressible and steady by virtue of the limited pore volume of the fracture relative to the reservoir.
- The fracture centerline is aligned with the $\hat{x}_D$-axis, which is rotated by an angle, θ, from the $x_D$-axis.

Cinco-L., H., Samaniego-V, F., and Dominguez-A, F., *Transient Pressure Behavior for a Well With a Finite-Conductivity Vertical Fracture*, SPEJ, 253 (August, 1978) show that the Laplace domain pressure distribution in a finite-conductivity fracture may be written as $$\bar{p}_{L_fD}(s) - \bar{p}_D(\hat{x}_D, s) = \frac{\pi\hat{x}_D}{sC_{fD}} - \frac{\pi}{C_{fD}} \int_0^{\hat{x}_D} \int_0^{x'} \bar{q}_{L_fD}(x'', s)\,dx''\,dx' \tag{C-1}$$

where $\bar{P}_D(\hat{x}_D,s)$ is the general reservoir solution and the dimensionless fracture conductivity is defined as, $$C_{fD} = \frac{k_f w_f}{kL_f}. \tag{C-2}$$

With the definitions above in Section IV, the multiple arbitrarily-oriented finite-conductivity fracture solution is written for a single fracture in the Laplace domain as presented by Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) as $$(\bar{p}_{wD})_\ell = \sum_{i=1}^{n_f} \frac{1}{2L_{f_iD}} \int_0^{L'_{f_iD}} \bar{q}_{iD}(x', s) \left[ K_0\left[\sqrt{u}\sqrt{\begin{matrix}[(\hat{x}_{iD})\cos(\theta_\ell - \theta_i) - x']^2 \\ +(\hat{x}_{iD})^2\sin^2(\theta_\ell - \theta_i)\end{matrix}}\right] + K_0\left[\sqrt{u}\sqrt{\begin{matrix}[(\hat{x}_{iD})\cos(\theta_\ell - \theta_i) - x']^2 \\ +(\hat{x}_{iD})^2\sin^2(\theta_\ell - \theta_i)\end{matrix}}\right]\right] dx' \frac{\pi\hat{x}_{\ell D}}{sC_{f_iD}} - \frac{\pi}{C_{f_iD}} \int_0^{\hat{x}_{\ell D}} \int_0^{\hat{x}} \bar{q}_{iD}(x'', s)\,dx''\,dx'$$

$$\ell = 1, 2, \ldots, n_f \tag{C-2}$$

A semianalytical solution for the multiple finite-conductivity fracture solution may be obtained with the discretization of both the reservoir component, which is described above in Section IV, and the fracture. As shown by Cinco-Ley, H. and Samaniego-V., F., *Transient Pressure Analysis: Finite Conductivity Fracture Case Versus Damage Fracture Case*, SPE 10179 (1981), the fracture-flow component, which may be written as $$\Psi = \int_0^{\hat{x}_{\ell D}} \int_0^{x'} \bar{q}_{\ell D}(x'', s)\,dx''\,dx', \tag{C-3}$$

may be approximated by $$\Psi_j = \begin{cases} \frac{(\Delta\hat{x}_{fD})^2}{8}(\bar{q}_{fD})_{j=1},\ j=1 \\ \frac{(\Delta\hat{x}_{fD})^2}{8}(\bar{q}_{fD})_j(s) + \sum_{m=1}^{j-1}\left[\frac{(\Delta\hat{x}_{fD})^2}{2} + (\Delta\hat{x}_{fD})[(\hat{x}_{fD})_j - m\Delta\hat{x}_{fD}]\right](\bar{q}_{fD})_m(s),\ j>1 \end{cases} \tag{C-4}$$

By combining the reservoir and fracture-flow components—and including anisotropy—a semianalytical multiple finite-conductivity fracture solution may be written as $$(\bar{P}_{wD})_\ell(s) = \begin{cases} \sum_{i=1}^{n_f}\sum_{m=1}^{n_{fs}} \frac{(\bar{q}_{iD})_m(s)}{2L'_{f_iD}} \int_{[\hat{x}_{iD}]_m}^{[\hat{x}_{iD}]_{m+1}} \left[ K_0\left[\sqrt{u}\sqrt{[(\hat{x}_{iD})_{j=1}\cos(\theta'_\ell-\theta'_i)-x']^2 + (\hat{x}_{iD})^2_{j=1}\sin^2(\theta'_\ell-\theta'_i)}\right] + K_0\left[\sqrt{u}\sqrt{[(\hat{x}_{iD})_{j=1}\cos(\theta'_\ell-\theta'_i)+x']^2 + (\hat{x}_{iD})^2_{j=1}\sin^2(\theta'_\ell-\theta'_i)}\right]\right] dx' - \frac{\pi}{C_{f_iD}}\frac{(\Delta\hat{x}_{fD})^2}{8}(\bar{q}_{fD})_{j=1}(s) + \frac{\pi(\hat{x}_{fD})_{j=1}}{sC_{f_iD}},\ j=1 \\ \sum_{i=1}^{n_f}\sum_{m=1}^{n_{fs}} \frac{(\bar{q}_{iD})_m(s)}{2L'_{f_iD}} \int_{[\hat{x}_{iD}]_m}^{[\hat{x}_{iD}]_{m+1}} \left[ K_0\left[\sqrt{u}\sqrt{[(\hat{x}_{iD})_j\cos(\theta'_\ell-\theta'_i)-x']^2 + (\hat{x}_{iD})^2_j\sin^2(\theta'_\ell-\theta'_i)}\right] + K_0\left[\sqrt{u}\sqrt{[(\hat{x}_{iD})_j\cos(\theta'_\ell-\theta'_i)+x']^2 + (\hat{x}_{iD})^2_j\sin^2(\theta'_\ell-\theta'_i)}\right]\right] dx' - \frac{\pi}{C_{f_iD}}\left[\frac{(\Delta\hat{x}_{fD})^2}{8}(\bar{q}_{fD})_j(s) + \sum_{m=1}^{j-1}\left[\frac{(\Delta\hat{x}_{fD})^2}{2} + (\Delta\hat{x}_{fD})[(\hat{x}_{fD})_j - m\Delta\hat{x}_{fD}]\right](\bar{q}_{fD})_m(s)\right] + \frac{\pi(\hat{x}_{fD})_j}{sC_{f_iD}},\ j>1 \end{cases} \tag{C-5}$$

for j=1,2 . . . , $n_{fs}$ and l=1,2, . . . , $n_f$ with the Laplace domain dimensionless total flow rate defined by $$\sum_{i=1}^{n_f}\Delta\hat{x}_{iD}\sum_{m=1}^{n_{fs}}(\bar{q}_{iD})_m = \frac{1}{s}, \tag{C-6}$$

and a equation relating the dimensionless pressure at the well bore for each fracture written as $$(\bar{P}_{wD})_1=(\bar{P}_{wD})_2= \ldots =(\bar{P}_{wD})_{nf}=\bar{P}_{LfD}. \tag{C-7}$$

Figure 7:
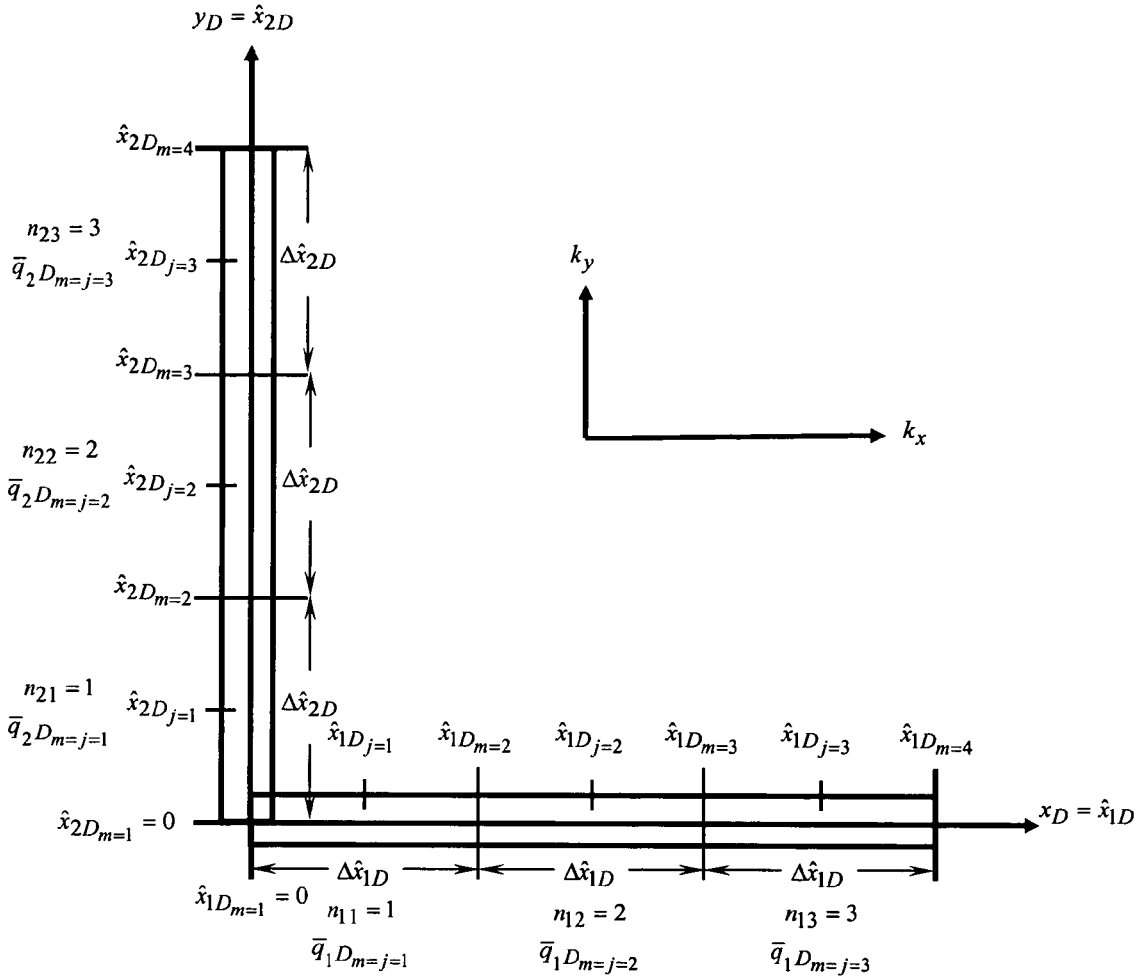
FIG. 7 shows a discretization of a cruciform fracture.

For each fracture divided into $n_{fs}$ equal length uniform-flux segments, Eqs. C-5 through C-7 describe a system of $n_f n_{fs}+2$ equations and $n_f n_{fs}+2$ unknowns. Solving the system of equations requires writing an equation for each fracture segment. For example consider the discretized cruciform fracture with each fracture wing divided into three segments as shown in FIG. 7.

Define the following variables of substitution as $$(\zeta_i)_{mj} = \frac{1}{2L'_{f_iD}} \int_{[\hat{x}_{iD}]_m}^{[\hat{x}_{iD}]_{m+1}} \left[ K_0\left[\sqrt{u}\sqrt{[(\hat{x}_{iD})_j\cos(\theta'_\ell-\theta'_i)-x']^2 + (\hat{x}_{iD})^2_j\sin^2(\theta'_\ell-\theta'_i)}\right] + K_0\left[\sqrt{u}\sqrt{[(\hat{x}_{iD})_j\cos(\theta'_\ell-\theta'_i)+x']^2 + (\hat{x}_{iD})^2_j\sin^2(\theta'_\ell-\theta'_i)}\right]\right] dx' \tag{C-16}$$

-continued $$(\chi_\ell)_{mj} = \frac{\pi}{C_{f\ell D}}\left[\frac{(\Delta\hat{x}_{fD})^2}{2} + (\Delta\hat{x}_{fD})[(\hat{x}_{fD})_j - m\Delta\hat{x}_{fD}]\right], \tag{C-17}$$

$$\xi_\ell = \frac{\pi}{C_{f\ell D}}\frac{(\Delta\hat{x}_{fD})^2}{8}, \tag{C-18}$$

and $$(\eta_\ell)_j = \frac{\pi(\hat{x}_{fD})_j}{C_{f\ell D}}. \tag{C-19}$$

For the cruciform fracture in an anisotropic reservoir illustrated in FIG. 7, the primary fracture is oriented at an angle $\theta_{f_1}=\theta'_{f_1}=\theta_{f_r}=0$ and the secondary fracture is oriented at an angle $\theta_{f_2}=\theta'_{f_2}=\pi/2$. Let the reference length be defined as $L=L'_{f_1}$, and let the length of the secondary fracture be defined as $L'_{f_2}=\delta_2 L'_{f_1}$. Consequently, the dimensionless fracture half-lengths are defined as $L'_{f_1D}=1$, and $L'_{f_2D}=\delta_2 L'_{f_1D}=\delta_2$.

Let j=1, and the dimensionless pressure equation for the primary fracture may be written after collecting like terms as $$(\bar{p}_{wD})_1 + \begin{bmatrix} [\xi_1 - (\zeta_1)_{11}](\bar{q}_{1D})_1 - (\zeta_1)_{21}(\bar{q}_{1D})_2 - (\zeta_1)_{31}(\bar{q}_{1D})_3 - \\ (\zeta_2)_{11}(\bar{q}_{2D})_1 - (\zeta_2)_{21}(\bar{q}_{2D})_2 - (\zeta_2)_{31}(\bar{q}_{2D})_3 \end{bmatrix} = \frac{(\eta_1)_1}{s} \tag{C-20}$$

For j=2, the dimensionless pressure equation may be written as $$(\bar{p}_{wD})_1 + \begin{bmatrix} [(\chi_1)_{12} - (\zeta_1)_{12}](\bar{q}_{1D})_1 + [\xi_1 - (\zeta_1)_{22}](\bar{q}_{1D})_2 - \\ (\zeta_1)_{32}(\bar{q}_{1D})_3 - (\zeta_2)_{12}(\bar{q}_{2D})_1 - \\ (\zeta_2)_{22}(\bar{q}_{2D})_2 - (\zeta_2)_{32}(\bar{q}_{2D})_3 \end{bmatrix} = \frac{(\eta_1)_2}{s} \tag{C-21}$$

and for j=3, the dimensionless pressure equation may be written as $$(\bar{p}_{wD})_1 + \begin{bmatrix} [(\chi_1)_{13} - (\zeta_1)_{13}](\bar{q}_{1D})_1 + [(\chi_1)_{23} - (\zeta_1)_{23}](\bar{q}_{1D})_2 + \\ [\xi_1 - (\zeta_1)_{33}](\bar{q}_{1D})_3 - (\zeta_2)_{13}(\bar{q}_{2D})_1 - \\ (\zeta_2)_{23}(\bar{q}_{2D})_2 - (\zeta_2)_{33}(\bar{q}_{2D})_3 \end{bmatrix} = \frac{(\eta_1)_3}{s} \tag{C-22}$$

The dimensionless pressure equation for the secondary fracture may be written for j=1 as $$(\bar{p}_{wD})_2 + \begin{bmatrix} -(\zeta_1)_{11}(\bar{q}_{1D})_1 - (\zeta_1)_{21}(\bar{q}_{1D})_2 - (\zeta_1)_{31}(\bar{q}_{1D})_3 \\ [\xi_2 - (\zeta_2)_{11}](\bar{q}_{2D})_1 - (\zeta_2)_{21}(\bar{q}_{2D})_2 - (\zeta_2)_{31}(\bar{q}_{2D})_3 \end{bmatrix} = \frac{(\eta_2)_1}{s} \tag{C-23}$$

For j=2, the dimensionless pressure equation for the secondary fracture may be written as $$(\bar{p}_{wD})_2 + \begin{bmatrix} -(\zeta_1)_{12}(\bar{q}_{1D})_1 - (\zeta_1)_{22}(\bar{q}_{1D})_2 - (\zeta_1)_{32}(\bar{q}_{1D})_3 \\ [(\chi_2)_{12} - (\zeta_2)_{12}](\bar{q}_{2D})_1 + [\xi_2 - (\zeta_2)_{22}](\bar{q}_{2D})_2 - \\ (\zeta_2)_{32}(\bar{q}_{2D})_3 \end{bmatrix} = \frac{(\eta_2)_2}{s} \tag{C-24}$$

and for j=3, the dimensionless pressure equation may be written as $$(\bar{p}_{wD})_2 + \begin{bmatrix} -(\zeta_1)_{13}(\bar{q}_{1D})_1 - (\zeta_1)_{23}(\bar{q}_{1D})_2 - (\zeta_1)_{33}(\bar{q}_{1D})_3 \\ [(\chi_2)_{13} - (\zeta_2)_{13}](\bar{q}_{2D})_1 + [(\chi_2)_{23} - (\zeta_2)_{23}](\bar{q}_{2D})_2 + \\ [\xi_2 - (\zeta_2)_{33}](\bar{q}_{2D})_3 \end{bmatrix} = \frac{(\eta_2)_3}{s} \tag{C-25}$$

With the rate equation expanded and written as $$\Delta\hat{x}_{1D}(\bar{q}_{1D})_1 + \Delta\hat{x}_{1D}(\bar{q}_{1D})_2 + \Delta\hat{x}_{1D}(\bar{q}_{1D})_3 + \tag{C-32}$$

-continued $$\Delta\hat{x}_{2D}(\bar{q}_{2D})_1 + \Delta\hat{x}_{2D}(\bar{q}_{2D})_2 + \Delta\hat{x}_{2D}(\bar{q}_{2D})_3 = \frac{1}{s}$$

and recognizing $(\bar{P}_{wD})_1=(\bar{P}_{wD})_2=\bar{P}_{L_fD}$, the linear system of equations may also be written in matrix form as $$Ax=b, \tag{C-33}$$

where $$A = \begin{bmatrix} A_1 & Z_2 & I \\ Z_2 & A_2 & I \\ \Delta_1 & \Delta_2 & 0 \end{bmatrix}, \tag{C-34}$$

$$A_1 = \begin{bmatrix} [\xi_1 - (\zeta_1)_{11}] & -(\zeta_1)_{21} & -(\zeta_1)_{31} \\ [(\chi_1)_{12} - (\zeta_1)_{12}] & [\xi_1 - (\zeta_1)_{22}] & -(\zeta_1)_{32} \\ [(\chi_1)_{13} - (\zeta_1)_{13}] & [(\chi_1)_{23} - (\zeta_1)_{23}] & [\xi_1 - (\zeta_1)_{33}] \end{bmatrix}, \tag{C-35}$$

$$A_2 = \begin{bmatrix} [\xi_2 - (\zeta_2)_{11}] & -(\zeta_2)_{21} & -(\zeta_2)_{31} \\ [(\chi_2)_{12} - (\zeta_2)_{12}] & [\xi_2 - (\zeta_2)_{22}] & -(\zeta_2)_{32} \\ [(\chi_2)_{13} - (\zeta_2)_{13}] & [(\chi_1)_{23} - (\zeta_2)_{23}] & [\xi_2 - (\zeta_2)_{33}] \end{bmatrix}, \tag{C-36}$$

$$Z_1 = \begin{bmatrix} -(\zeta_1)_{11} & -(\zeta_1)_{21} & -(\zeta_1)_{31} \\ -(\zeta_1)_{12} & -(\zeta_1)_{22} & -(\zeta_1)_{32} \\ -(\zeta_1)_{13} & -(\zeta_1)_{23} & -(\zeta_1)_{33} \end{bmatrix}, \tag{C-37}$$

$$Z_2 = \begin{bmatrix} -(\zeta_2)_{11} & -(\zeta_2)_{21} & -(\zeta_2)_{31} \\ -(\zeta_2)_{12} & -(\zeta_2)_{22} & -(\zeta_2)_{32} \\ -(\zeta_2)_{13} & -(\zeta_2)_{23} & -(\zeta_2)_{33} \end{bmatrix}, \tag{C-38}$$

$$I = \begin{bmatrix} 1 \\ 1 \\ 1 \end{bmatrix}, \tag{C-39}$$

$$\Delta_1 = [\ \Delta\hat{x}_{1D} \quad \Delta\hat{x}_{1D} \quad \Delta\hat{x}_{1D}\ ], \tag{C-40}$$

$$\Delta_2 = [\ \Delta\hat{x}_{2D} \quad \Delta\hat{x}_{2D} \quad \Delta\hat{x}_{2D}\ ], \tag{C-41}$$

$$x = \begin{bmatrix} q_1 \\ q_2 \\ \bar{p}_{L_fD}(s) \end{bmatrix}, \tag{C-42}$$

$$q_1 = \begin{bmatrix} (\bar{q}_{1D})_1(s) \\ (\bar{q}_{1D})_2(s) \\ (\bar{q}_{1D})_3(s) \end{bmatrix}, \tag{C-43}$$

$$q_2 = \begin{bmatrix} (\bar{q}_{2D})_1(s) \\ (\bar{q}_{2D})_2(s) \\ (\bar{q}_{2D})_3(s) \end{bmatrix}, \tag{C-44}$$

$$b = \begin{bmatrix} b_1 \\ b_2 \\ 1/s \end{bmatrix}, \tag{C-45}$$

$$b_1 = \begin{bmatrix} \frac{(\eta_1)_1}{s} \\ \frac{(\eta_1)_2}{s} \\ \frac{(\eta_1)_3}{s} \end{bmatrix}, \tag{C-46}$$

and

-continued $$b_2 = \begin{bmatrix} \frac{(\eta_2)_1}{s} \\ \frac{(\eta_2)_2}{s} \\ \frac{(\eta_2)_3}{s} \end{bmatrix}. \quad \text{(C-47)}$$

Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) demonstrates that the system of equations may also be written in a general form for $n_f$ fractures with $n_{fs}$ segments.

Figure 8:
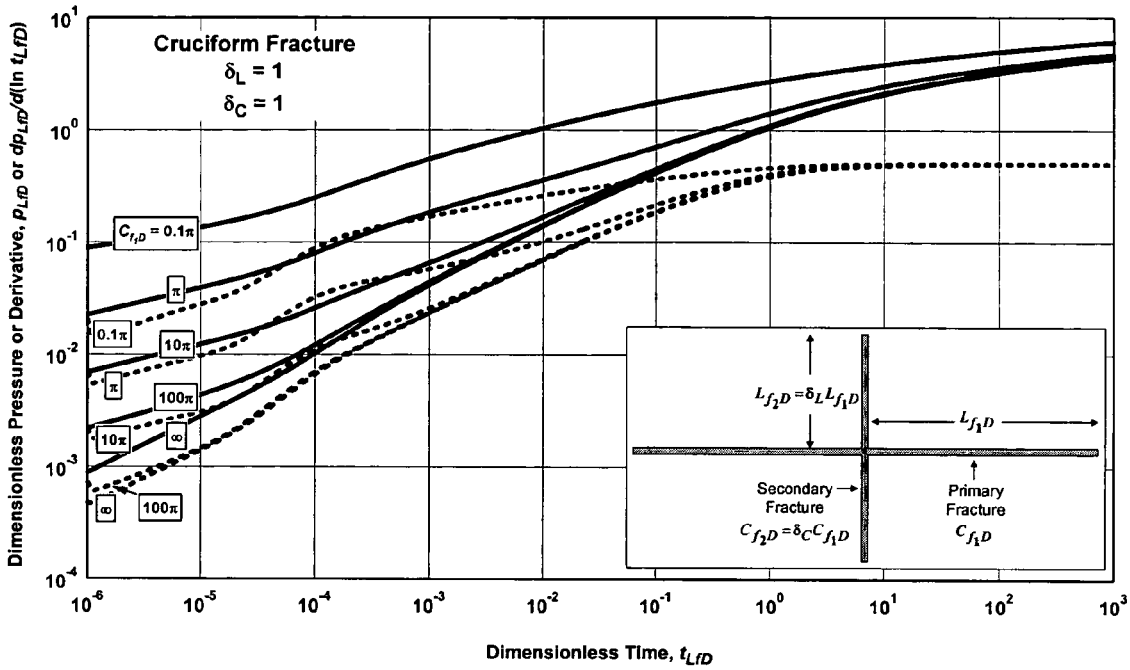
FIG. 8 log-log graph of dimensionless pressure versus dimensionless time for an finite-conductivity cruciform fracture with $\delta_L=1$ and $\delta_C=1$.

FIG. 8 contains a log-log graph of dimensionless pressure and dimensionless pressure derivative versus dimensionless time for a cruciform fracture where the angle between the fractures is $\pi/2$. In FIG. 8, $\delta_L=1$, and the inset graphic illustrates a cruciform fracture with primary fracture conductivity, $C_{f1D}$, and the secondary fracture conductivity is defined by the ratio of secondary to primary fracture conductivity, $\delta_c=C_{f2D}/C_{f1D}$ where in FIG. 8, $\delta_C=1$.

Figure 9:
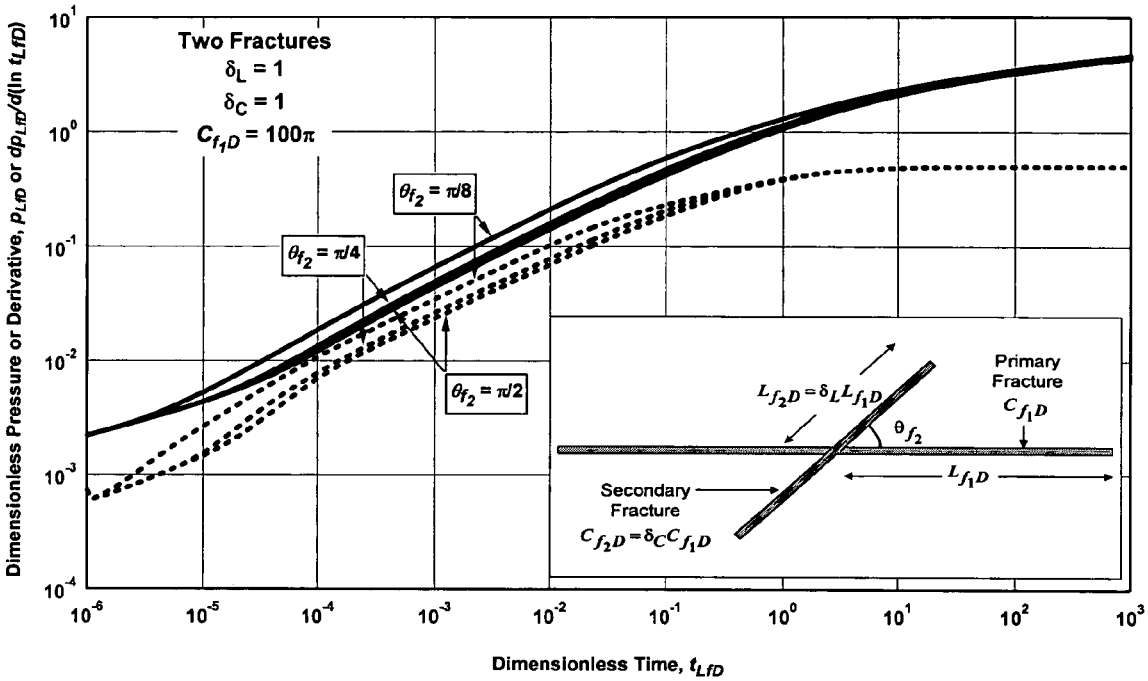
FIG. 9 log-log graph of dimensionless pressure versus dimensionless time for an finite-conductivity fractures with $\delta_L=1$, $\delta_C=1$, and intersecting at an angle of $\pi/2$, $\pi/4$, and $\pi/8$.

In addition to allowing each fracture to have a different half length and conductivity, the multiple fracture solution also allows for an arbitrary angle between fractures. FIG. 9 contains constant-rate type curves for equal primary and secondary fracture half length, $\delta_L=1$ and equal primary and secondary conductivity, $\delta_C=1$ where $C_{f1D}=100\pi$. The type curves illustrate the effects of decreasing the angle between the fractures as shown by type curves for $\theta_{f2}=\pi/2$, $\pi/4$, and $\pi/8$.

VI. Nomenclature

The nomenclature, as used herein, refers to the following terms:

A=fracture area during propagation, $L^2$, $m^2$
$A_f$=fracture area, $L^2$, $m^2$
$A_{ij}$=matrix element, dimensionless
B=formation volume factor, dimensionless
$c_f$=compressibility of fluid in fracture, $Lt^2/m$, $Pa^{-1}$
$c_t$=total compressibility, $Lt^2/m$, $Pa^{-1}$
$c_{wb}$=compressibility of fluid in wellbore, $Lt^2/m$, $Pa^{-1}$
C=wellbore storage, $L^4t^2/m$, $m^3/Pa$
$C_f$=fracture conductivity, $m^3$, $m^3$
$C_{ac}$=after-closure storage, $L^4t^2/m$, $m^3/Pa$
$C_{bc}$=before-closure storage, $L^4t^2/m$, $m^3/Pa$
$C_{pf}$=propagating-fracture storage, $L^4t^2/m$, $m^3/Pa$
$C_{fbc}$=before-closure fracture storage, $L^4t^2/m$, $m^3/Pa$
$C_{pLf}$=propagating-fracture storage with multiple fractures, $L^4t^2/m$, $m^3/Pa$
$C_{Lfac}$=after-closure multiple fracture storage, $L^4t^2/m$, $m^3/Pa$
$C_{Lfbc}$=before-closure multiple fracture storage, $L^4t^2/m$, $m^3/Pa$
h=height, L, m
$h_f$=fracture height, L, m
I=integral, m/Lt, Pa·s
k=permeability, $L^2$, $m^2$
$k_x$=permeability in x-direction, $L^2$, $m^2$
$k_y$=permeability in y-direction, $L^2$, $m^2$
$K_0$=modified Bessel function of the second kind (order zero), dimensionless
L=propagating fracture half length, L, m
$L_f$=fracture half length, L, m
$n_f$=number of fractures, dimensionless
$n_{fs}$=number of fracture segments, dimensionless
$p_0$=wellbore pressure at time zero, $m/Lt^2$, Pa
$p_c$=fracture closure pressure, $m/Lt^2$, Pa
$p_f$=reservoir pressure with production from a single fracture, $m/Lt^2$, Pa
$p_i$=average reservoir pressure, $m/Lt^2$, Pa
$P_n$=fracture net pressure, $m/Lt^2$, Pa
$P_w$=wellbore pressure, $m/Lt^2$, Pa
$P_{ac}$=reservoir pressure with constant after-closure storage, $m/Lt^2$, Pa
$P_{Lf}$=reservoir pressure with production from multiple fractures, $m/Lt^2$, Pa
$P_{pf}$=reservoir pressure with a propagating fracture, $m/Lt^2$, Pa
$P_{wc}$=wellbore pressure with constant flow rate, $m/Lt^2$, Pa
$P_{ws}$=welibore pressure with variable flow rate, $m/Lt^2$, Pa
$P_{fac}$=fracture pressure with constant after-closure fracture storage, $m/Lt^2$, Pa
$P_{pLf}$=reservoir pressure with a propagating secondary fracture, $m/Lt^2$, Pa
$P_{Lfac}$=reservoir pressure with production from multiple fractures and constant after-closure storage, $m/Lt^2$, Pa
$P_{Ljbc}$=reservoir pressure with production from multiple fractures and constant before-closure storage, $m/Lt^2$, Pa
q=reservoir flow rate, $L^3/t$, $m^3/s$
$\tilde{q}$=fracture-face flux, $L^3/t$, $m^3/s$
$q_w$=wellbore flow rate, $L^3/t$, $m^3/s$
$q_l$=fluid leakoff rate, $L^3/t$, $m^3/s$
$q_s$=reservoir flow rate, $L^3/t$, $m^3/s$
$q_t$=total flow rate, $L^3/t$, $m^3/s$
$q_f$=fracture flow rate, $L^3/t$, $m^3/s$
$q_{pf}$=propagating-fracture flow rate, $L^3/t$, $m^3/s$
$q_{sf}$=sand-face flow rate, $L^3/t$, $m^3/s$
$q_{ws}$=wellbore variable flow rate, $L^3/t$, $m^3/s$
r=radius, L, m
s=Laplace transform variable, dimensionless
$s_e$=Laplace transform variable at the end of injection, dimensionless
$S_f$=fracture stiffness, $m/L^2t^2$, Pa/m
$S_{fs}$=fracture-face skin, dimensionless
$(S_{fs})_{ch}$=choked-fracture skin, dimensionless
t=time, t, s
$t_e$=time at the end of an injection, t, s
$t_c$=time at hydraulic fracture closure, t, s
$t_{LfD}$=dimensionless time, dimensionless
u=variable of substitution, dimensionless
$U_a$=Unit-step function, dimensionless
$V_f$=fracture volume, $L^3$, $m^3$
$V_{fr}$=residual fracture volume, $L^3$, $m^3$
$V_w$=wellbore volume, $L^3$, $m^3$
$\hat{w}_f$=average fracture width, L, m
x=coordinate of point along x-axis, L, m
$\hat{x}$=coordinate of point along $\hat{x}$-axis, L, m
$x_w$=wellbore position along x-axis, L, m
y=coordinate of point along y-axis, L, m
$\hat{y}$=coordinate of point along $\hat{y}$-axis, L, m
$y_w$=wellbore position along y-axis, L, m
$\alpha$=fracture growth exponent, dimensionless
$\delta_L$=ratio of secondary to primary fracture half length, dimensionless
$\Delta$=difference, dimensionless
$\zeta$=variable of substitution, dimensionless
$\eta$=variable of substitution, dimensionless
$\theta_r$=reference angle, radians
$\theta_f$=fracture angle, radians
$\mu$=viscosity, m/Lt, Pa·s
$\xi$=variable of substitution, dimensionless
$\rho$=density, $m/L^3$, $kg/m^3$
$\tau$=variable of substitution, dimensionless $\phi$=porosity, dimensionless
$\chi$=variable of substitution, dimensionless
$\psi$=variable of substitution, dimensionless Subscripts
D=dimensionless
i=fracture index, dimensionless
j=segment index, dimensionless
l=fracture index, dimensionless
m=segment index, dimensionless
n=time index, dimensionless To facilitate a better understanding of the present invention, the following examples of certain aspects of some embodiments are given. In no way should the following examples be read to limit, or define, the scope of the invention.

EXAMPLES

Field Example

Figure 10:
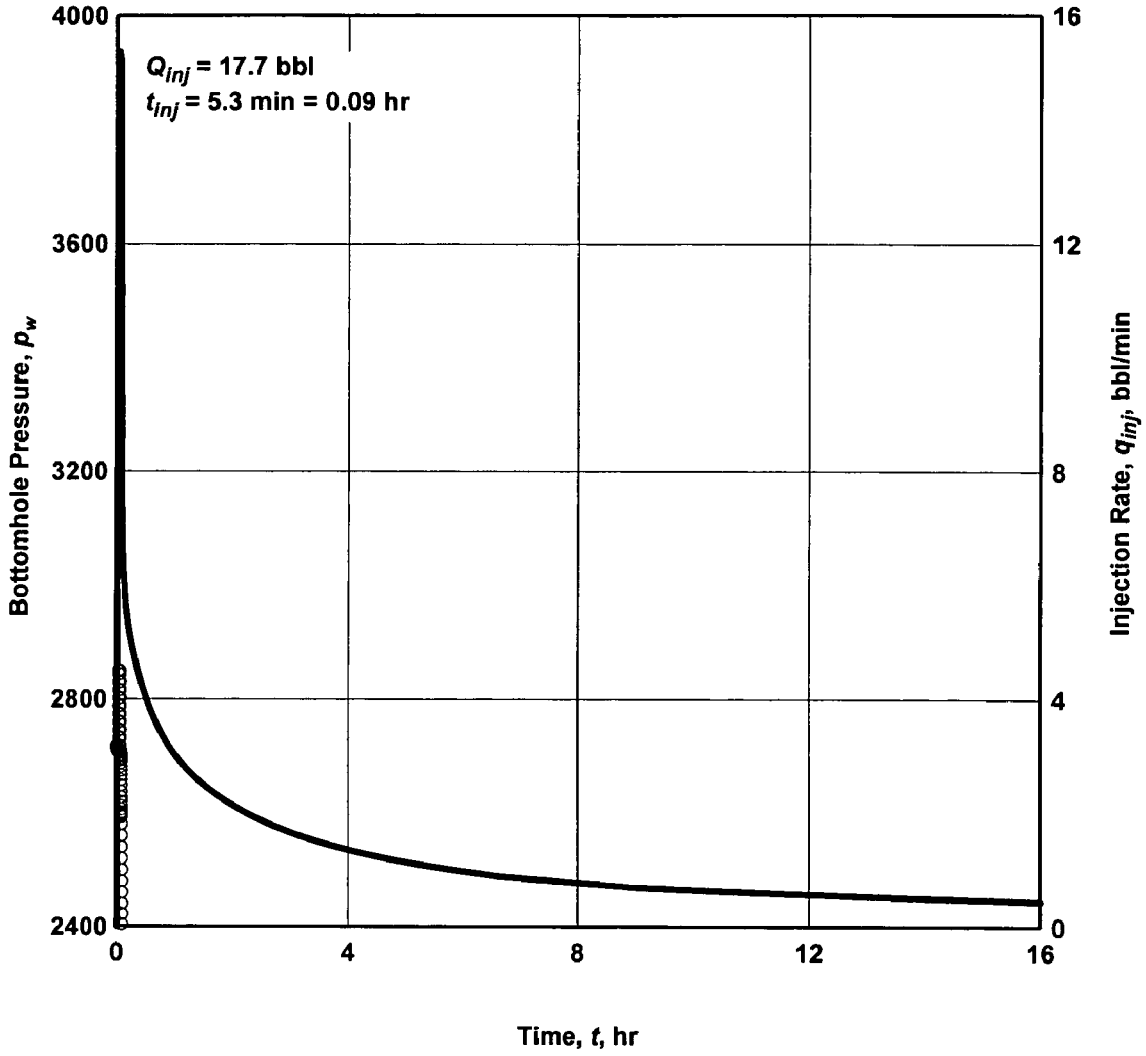
FIG. 10 shows an example fracture-injection/falloff test without a pre-existing hydraulic fracture.
Figure 11:
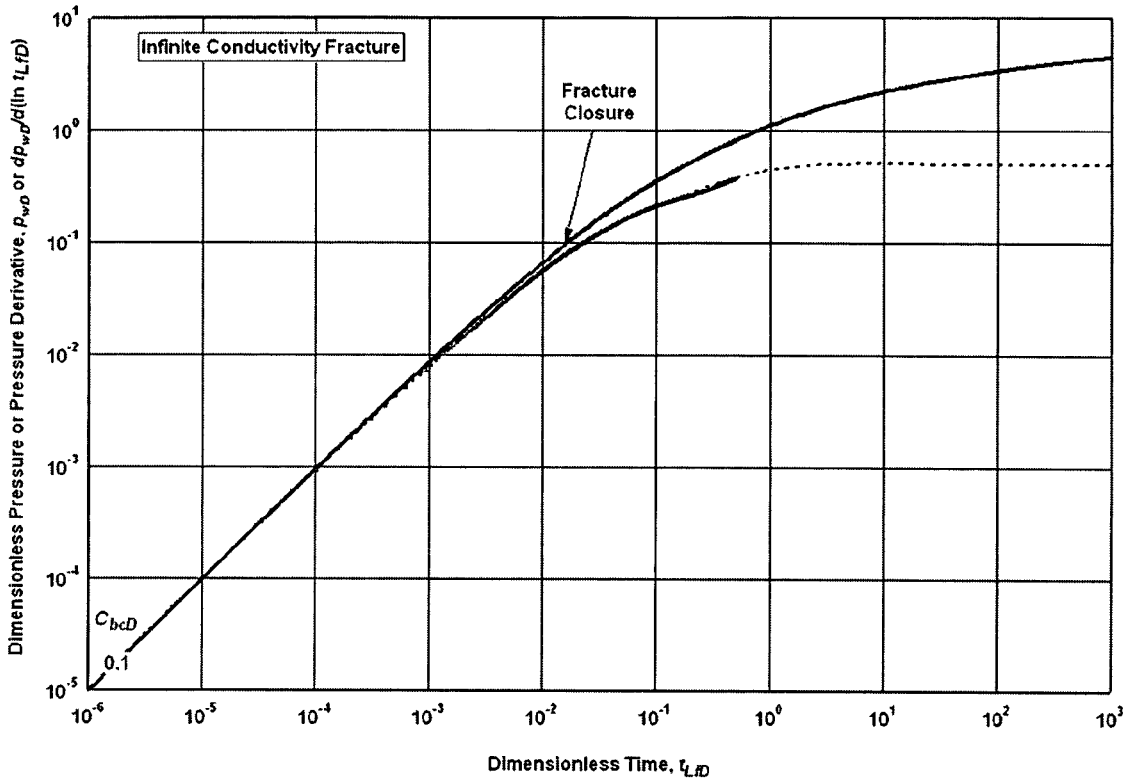
FIG. 11 shows an example type-curve match for a fracture-injection/falloff test without a pre-existing hydraulic fracture.

A fracture-injection/falloff test in a layer without a pre-existing fracture is shown in FIG. 10, which contains a graph of injection rate and bottomhole pressure versus time. A 5.3 minute injection consisted of 17.7 bbl of 2% KCl treated water followed by a 16 hour shut-in period. FIG. 11 contains a graph of equivalent constant-rate pressure and pressure derivative-plotted in terms of adjusted pseudovariables using methods such as those disclosed in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005)-overlaying a constant-rate drawdown type curve for a well producing from an infinite-conductivity vertical fracture with constant storage. Fracture half length is estimated to be 127 ft using Nolte-Shlyapobersky analysis as disclosed in Correa, A. C. and Ramey, H. J., Jr., *Combined Effects of Shut-In and Production: Solution With a New Inner Boundary Condition*, SPE 15579 (1986) and the permeability from a type curve match is 0.827 md, which agrees reasonably well with a permeability of 0.522 md estimated from a subsequent pressure buildup test type-curve match.

Figure 12:
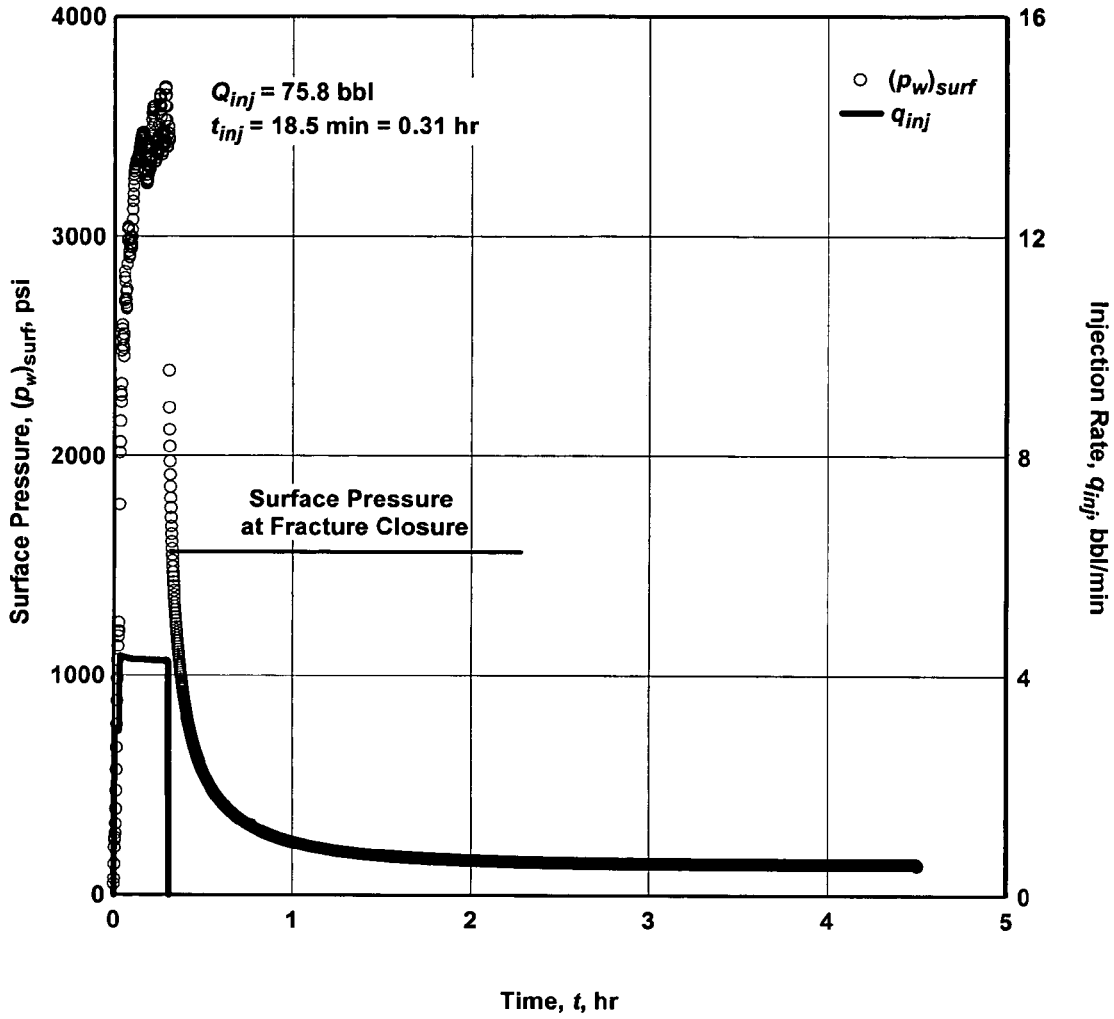
FIG. 12 shows an example refracture-candidate diagnostic test with a pre-existing hydraulic fracture.
Figure 13:
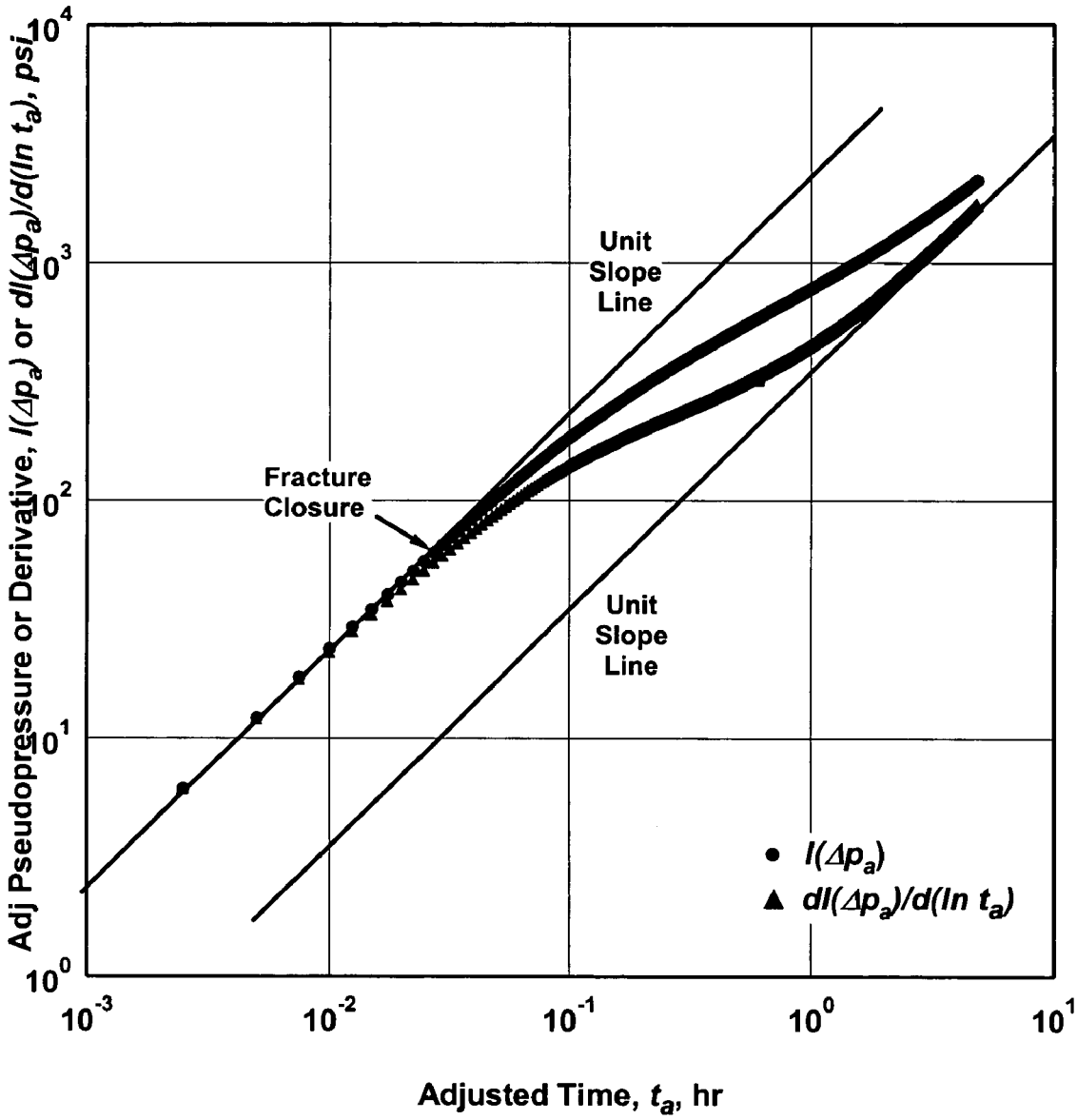
FIG. 13 shows an example refracture-candidate diagnostic test log-log graph with a damaged pre-existing hydraulic fracture.

A refracture-candidate diagnostic test in a layer with a pre-existing fracture is shown in FIG. 12, which contains a graph of injection rate and bottomhole pressure versus time. Prior to the test, the layer was fracture stimulated with 250,000 lbs of 20/40 proppant, but after 7 days, the layer was producing below expectations and a diagnostic test was used. The 18.5 minute injection consisted of 75.8 bbl of 2% KCl treated water followed by a 4 hour shut-in period. FIG. 13 contains a graph of equivalent constant-rate pressure and pressure derivative versus shut-in time plotted in terms of adjusted pseudovariables using methods such as those disclosed in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) and exhibits the characteristic response of a damaged fracture with choked-fracture skin. Note that the transition from the first unit-slope line to the second unit slope line begins at hydraulic fracture closure. Consequently, the refracture-candidate diagnostic test qualitatively indicates a damaged pre-existing fracture retaining residual width. Since the data did not extend beyond the end of storage, quantitative analysis is not possible.

Thus, the above results show, among other things:

An isolated-layer refracture-candidate diagnostic test may use a small volume, low-rate injection of liquid or gas at a pressure exceeding the fracture initiation and propagation pressure followed by an extended shut-in period.

Provided the injection time is short relative to the reservoir response, a refracture-candidate diagnostic may be analyzed as a slug test.

A change in storage at fracture closure qualitatively may indicate the presence of a pre-existing fracture. Apparent increasing storage may indicate that the pre-existing fracture is damaged.

Quantitative type-curve analysis using variable-storage, constant-rate drawdown solutions for a reservoir producing from multiple arbitrarily-oriented infinite or finite conductivity fractures may be used to estimate fracture half length(s) and reservoir transmissibility of a formation.

Therefore, the present invention is well adapted to attain the ends and advantages mentioned as well as those that are inherent therein. While numerous changes may be made by those skilled in the art, such changes are encompassed within the spirit of this invention as defined by the appended claims. The terms in the claims have their plain, ordinary meaning unless otherwise explicitly and clearly defined by the patentee.

What is claimed is:

1. A method for determining a reservoir transmissibility of at least one layer of a subterranean formation having preexisting fractures having a reservoir fluid comprising the steps of:

(a) isolating the at least one layer of the subterranean formation to be tested;

(b) introducing an injection fluid into the at least one layer of the subterranean formation at an injection pressure exceeding the subterranean formation fracture pressure for an injection period;

(c) shutting in the wellbore for a shut-in period;

(d) measuring pressure falloff data from the subterranean formation during the injection period and during a subsequent shut-in period; and (e) determining quantitatively the reservoir transmissibility of the at least one layer of the subterranean formation by analyzing the pressure falloff data with a quantitative refracture-candidate diagnostic model.

2. The method of claim 1 wherein step (e) is accomplished by transforming the pressure falloff data to equivalent constant-rate pressures and using type curve analysis to match the equivalent constant-rate pressures to a type curve to determine quantitatively the reservoir transmissibility.

3. The method of claim 1 wherein step (e) is accomplished by:

transforming the pressure falloff data to obtain equivalent constant-rate pressures;

preparing a log-log graph of the equivalent constant-rate pressures versus time; and determine quantitatively the reservoir transmissibility of the at least one layer of the subterranean formation by analyzing the variable-rate pressure falloff data using type-curve analysis according to the quantitative refracture-candidate diagnostic model.

4. The method of claim 2 wherein the reservoir fluid is compressible; and wherein the transforming of the pressure falloff data is based on the properties of the compressible reservoir fluid in the reservoir wherein the transforming step comprises:

determining a shut-in time relative to the end of the injection period;

determining an adjusted time; and determining an adjusted pseudopressure difference.

5. The method of claim 4 wherein the transforming step comprises:

determining the shut-in time relative to the end of the injection: $\Delta t = t - t_{ne}$;

determining the adjusted time:

$$t_a = (\overline{\mu c_t}) \int_0^{\Delta t} \frac{d\Delta t}{(\mu c_t)_w};$$

and determining the adjusted pseudopressure difference: $\Delta P_a(t) = P_{aw}(t) - P_{ai}$ where $$p_a = \frac{\overline{\mu}_g \overline{z}}{\overline{p}} \int_0^{\overline{p}} \frac{p\,dp}{\mu_g z};$$

wherein:

$t_{ne}$ is the time at the end of the injection period;

$\overline{\mu}$ is the viscosity of the reservoir fluid at average reservoir pressure;

$(\mu c_t)_w$ is the viscosity compressibility product of wellbore fluid at time t;

$(\mu c_t)_0$ is the viscosity compressibility product of wellbore fluid at time $t = t_{ne}$;

p is the pressure;

$\overline{p}$ is the average reservoir pressure;

$P_{aw}(t)$ is the adjusted pressure at time t;

$p_{ai}$ is the adjusted pressure at time $t = t_{ne}$;

$c_t$ is the total compressibility;

$\overline{c}_t$ is the total compressibility at average reservoir pressure; and z is the real gas deviator factor.

6. The method of claim 5 further comprising the step of preparing a log-log graph of a pressure function versus time: $I(\Delta P_a) = f(t_a)$, where $$I(\Delta p_a) = \int_0^{a} \Delta p_a\, dt_a.$$

7. The method of claim 5 further comprising the step of preparing a log-log graph of a pressure derivative function versus time: $\Delta P_a' = f(t_a)$, where $$\Delta p_a' = \frac{d(\Delta p_a)}{d(\ln t_a)} = \Delta p_a t_a.$$

8. The method of claim 2 wherein the reservoir fluid is slightly compressible; and wherein the transforming of the pressure falloff data is based on the properties of the slightly compressible reservoir fluid in the reservoir wherein the transforming step comprise:

determining a shut-in time relative to the end of the injection period; and determining a pressure difference;

wherein:

$t_{ne}$ is the time at the end of the injection period;

$P_w(t)$ is the pressure at time t; and $P_i$ is the initial pressure at time $t = t_{ne}$.

9. The method of claim 8 wherein the transforming step comprises:

determining the shut-in time relative to the end of the injection: $\Delta t = t - t_{ne}$; and determining the pressure difference: $\Delta P(t) = P_w(t) - P_i$; and wherein:

$t_{ne}$ is the time at the end of the injection period;

$P_w(t)$ is the pressure at time t; and $P_i$ is the initial pressure at time $t = t_{ne}$.

10. The method of claim 8 further comprising the step of plotting a log-log graph of a pressure function versus time: $I(\Delta p) = f(\Delta t)$.

11. The method of claim 9 where $$I(\Delta p) = \int_0^{\Delta t} \Delta p\, d\Delta t \text{ or } \int_0^{t} \Delta p\, dt.$$

12. The method of claim 8 further comprising the step of plotting a log-log graph of a pressure derivatives function versus time: $\Delta p' = f(\Delta t)$.

13. The method of claim 12 where $$\Delta p' = \frac{d(\Delta p)}{d(\ln \Delta t)} = \Delta p \Delta t \text{ or } \frac{d(\Delta p)}{d(\ln t)} = \Delta p t.$$

14. The method of claim 9 wherein the reservoir transmissibility is determined quantitatively in field units from a before-closure match point as:

$$\frac{kh}{\mu} = 141.2(24) p_{wsD}(0) C_{Lfbc}(p_0 - p_i)\left[\frac{p_{LfbcD}(t_D)}{I(\Delta p)}\right]_M.$$

15. The method of claim 9 wherein the reservoir transmissibility is determined quantitatively in field units from an after-closure match point as:

$$\frac{kh}{\mu} = 141.2(24)\left[\begin{matrix} p_{wsD}(0) C_{Lfbc} \\ -p_{wsD}((t_c)_{Lfd}[C_{Lfbc} - C_{Lfac}] \end{matrix}\right](p_0 - p_i)\left[\frac{p_{LfacD}(t_D)}{I(\Delta p)}\right]_M.$$

16. The method of claim 5 wherein the injection fluid is compressible and contains desirable additives for compatibility with the subterranean formation wherein the reservoir transmissibility is determined quantitatively in field units from a before-closure match point as:

$$\frac{kh}{\mu} = 141.2(24) p_{awsD}(0) C_{Lfbc}(p_{a0} - p_{ai})\left[\frac{p_{LfbcD}(t_D)}{I(\Delta p_a)}\right]_M.$$

17. The method of claim 5 wherein the injection fluid is compressible and contains desirable additives for compatibility with the subterranean formation wherein the reservoir transmissibility is determined quantitatively in field units from an after-closure match point as:

$$\frac{kh}{\mu} = 141.2(24)\left[\begin{array}{c} p_{awsD}(0)C_{Lfbc} \\ -p_{awsD}((t_c)_{Lfd})[C_{Lfbc} - C_{Lfac}] \end{array}\right](p_{a0} - p_{ai})\left[\frac{p_{LfacD}(t_D)}{I(\Delta p_a)}\right]_M.$$

18. A system for determining a reservoir transmissibility of at least one layer of a subterranean formation by using variable-rate pressure falloff data from the at least one layer of the subterranean formation measured during an injection period and during a subsequent shut-in period, the system comprising:

a plurality of pressure sensors for measuring pressure falloff data; and a processor operable to transform the pressure falloff data to obtain equivalent constant-rate pressures and to determine quantitatively the reservoir transmissibility of the at least one layer of the subterranean formation by analyzing the variable-rate pressure falloff data using type-curve analysis according to a quantitative refracture-candidate diagnostic model.

19. A computer program, stored on a tangible storage medium, for analyzing at least one downhole property, the program comprising executable instructions that cause a computer to:

determine quantitatively a reservoir transmissibility of the at least one layer of the subterranean formation by analyzing the variable-rate pressure falloff data with a quantitative refracture-candidate diagnostic model.

20. The computer program of claim 19 wherein the determining step is accomplished by transforming the variable-rate pressure falloff data to equivalent constant-rate pressures and using type curve analysis to match the equivalent constant-rate rate pressures to a type curve to determine quantitatively the reservoir transmissibility.

21. The computer program of claim 19 wherein the determining step is accomplished by transforming the variable-rate pressure falloff data to equivalent constant-rate pressures and using after closure analysis to determine quantitatively the reservoir transmissibility.

* * * * *